US008887783B2

(12) United States Patent
Grassi et al.

(10) Patent No.: US 8,887,783 B2
(45) Date of Patent: Nov. 18, 2014

(54) UNIT FOR THE GLUE APPLICATION OF AT LEAST TWO LABELS TO CONTAINERS

(75) Inventors: Stefano Grassi, Castellucchio (IT); Antonella Prandi, legal representative, Castellucchio (IT); Georg Erhart, Kirchroth (DE); Giovanni Saccardi, Malavicina di Roverbella (IT)

(73) Assignee: Kosme S.R.L., Roverbella (IT)

( * ) Notice: Subject to any disclaimer, the term of this patent is extended or adjusted under 35 U.S.C. 154(b) by 324 days.

(21) Appl. No.: 13/392,667

(22) PCT Filed: Nov. 23, 2009

(86) PCT No.: PCT/IT2009/000529

§ 371 (c)(1), (2), (4) Date: May 11, 2012

(87) PCT Pub. No.: WO2011/061773

PCT Pub. Date: May 26, 2011

(65) Prior Publication Data

US 2012/0241097 A1 Sep. 27, 2012

(51) Int. Cl.

*B65C 9/26* (2006.01)
*B65C 3/16* (2006.01)
*B65C 3/18* (2006.01)

(52) U.S. Cl.

CPC .... *B65C 3/16* (2013.01); *B65C 3/18* (2013.01)
USPC .... 156/560; 156/568; 156/571; 156/DIG. 12; 156/DIG. 14

(58) Field of Classification Search

USPC ..... 156/560, 568, 571, 539, DIG. 12, 156/DIG. 14, DIG. 35
See application file for complete search history.

(56) References Cited

U.S. PATENT DOCUMENTS

| | | | | |
|---|---|---|---|---|
| 2,631,748 | A | 3/1953 | Schirmer | |
| 2,723,042 | A | 11/1955 | Banks | |
| 2,946,472 | A * | 7/1960 | Carter | 156/560 |
| 3,116,193 | A | 12/1963 | Ehlenbeck | |
| 3,200,027 | A | 8/1965 | Fairest | |
| 3,748,210 | A | 7/1973 | Beutl | |
| 4,032,388 | A * | 6/1977 | Dunning | 156/568 |

(Continued)

FOREIGN PATENT DOCUMENTS

| | | |
|---|---|---|
| DE | 1022150 | 1/1958 |
| DE | 2531737 A1 | 2/1976 |

(Continued)

*Primary Examiner* — Mark A Osele
(74) *Attorney, Agent, or Firm* — Pearne & Gordon LLP

(57) ABSTRACT

A unit for the glue application of at least two labels to containers, comprising at least first (8) and second application devices (9) both of which rotate and are positioned at two separate superposed portions of the main axis of rotation (Z), each for applying at least one label on a separate portion of the same container (2). The operating parts of the two application devices (8) and (9) are at different distances from the axis of rotation (Z), although they rotate at identical rotational speeds relative to said axis. The second application device (9) comprises two first follower elements (30) slidably connected to a stationary guide element (29), for guiding the movement of the second device At the label application position (24), the interaction between the first follower elements (30) and the guide element (29) causes an oscillation of the second application device (9) for varying the speed of movement of its operating part and adapting it to that of the container.

19 Claims, 20 Drawing Sheets

(56) References Cited

U.S. PATENT DOCUMENTS

| | | | | | |
|---|---|---|---|---|---|
| 4,090,913 | A | | 5/1978 | Zodrow | |
| 4,118,269 | A | | 10/1978 | Zodrow et al. | |
| 4,127,435 | A | * | 11/1978 | Zodrow | 156/568 |
| 4,146,421 | A | * | 3/1979 | Zodrow | 156/560 |
| 4,152,192 | A | * | 5/1979 | Zodrow et al. | 156/560 |
| 4,336,095 | A | | 6/1982 | Hoffmann | |
| 4,581,097 | A | | 4/1986 | Carter et al. | |
| 5,174,851 | A | * | 12/1992 | Zodrow et al. | 156/357 |
| 5,650,037 | A | | 7/1997 | Larson | |

FOREIGN PATENT DOCUMENTS

| | | |
|---|---|---|
| FR | 2507567 | 12/1982 |
| FR | 2581363 | 11/1986 |
| GB | 814975 A | 6/1959 |
| GB | 952231 | 8/1965 |
| GB | 1080370 | 8/1967 |
| WO | 9713645 | 4/1997 |

* cited by examiner

UNIT FOR THE GLUE APPLICATION OF AT LEAST TWO LABELS TO CONTAINERS

TECHNICAL FIELD

This invention relates to a unit for the glue application of at least two labels to containers.

Therefore, this invention is intended for the part of the sector of labelling machines in which glue is put on the labels only during the application step. In contrast, this invention is not intended for the sector of labelling using self-adhesive labels.

In particular, this invention relates to the unit which applies the labels on containers, in particular bottles, which are fed on the plates of a rotary carrousel.

BACKGROUND ART

At present, in the most simple solution intended for the application of only one label, application units of this type comprise a rotary shaft on which one or more application devices are mounted.

The shaft rotates about a main axis of rotation which is parallel with the axis of rotation of the carrousel. In this way, each application device cyclically passes from a label pickup position to a position for application of the label on the container. It should be noticed that the label is fed to the unit with glue already put on it. Upstream of the roller there is a label transfer blade which, after having glue put on it, picks up the label thanks to the action of the glue and feeds the label with glue on it to the application device.

For this purpose, the application devices comprise at least one pad made of elastically deformable material (such as a sponge) which forms an applying surface on which the label is retained during the passage from the pickup position to the application position. Moreover, the applying surface is pressed against the container to guarantee correct application of the label.

The preferred field for application of this invention is the labelling of bottles. In many cases, many different labels must be applied on each bottle: a main label on the front, a rear label on the back, a stamp or a neck label at the base of the neck, a band also on the neck, as well as a seal at the cap or cork.

Obviously, the simplest solution for applying such labels has for many years been the use of a different application unit for each type of label.

However, even in the labelling machines sector, as in many others, the need to minimise dimensions and costs is felt.

Consequently, over the years several types of machines were developed in which each labelling unit could simultaneously apply two different labels. That was possible thanks to the fact that, in general, two different labels are applied in such a way that they are vertically aligned with each other (for example a main label and stamp/neck label on one side, and a rear label and seal on the other).

Consequently, when the bottle is orientated for example in such a way as to allow application of the main label, it is also in the best position for application of the upper neck label/stamp or the seal.

Therefore, over the years several machines have been developed in which each application unit was doubled, that is to say, comprised one or more lower application devices (intended for applying the main label or the rear label) and one or more upper application devices (respectively intended for applying the stamp/neck label and the seal).

The movement of such double units was always guaranteed by a single rotary shaft.

However, that proved to be a problem as regards synchronisation of the speeds between the application device and the containers.

As is known, to be able to apply labels in the best possible way, the applying surface and the surface of the container must be brought into contact (obviously with the label interposed between them) with a rolling movement of one on the other without slipping.

However, since the bottle neck has a diameter which is smaller than the bottle body, during bottle rotation (about the axis of rotation of the carrousel or about its own central axis by means of rotation of the supporting plate), the surface of the neck moves with a tangential speed which is less than that of the surface of the body.

Consequently, for ideal application of the labels, on one hand the upper application devices would need to have, at their applying surface which is pressed against the bottle, a tangential speed equal to that of the surface of the bottle neck, and on the other hand the lower application devices would need to have, at their applying surface which is pressed against the bottle, a tangential speed equal to that of the surface of the bottle body, and therefore a tangential speed greater than that of the upper application devices.

However, said requirement clashes with the need, dictated by dimensions, to move the lower and upper application devices using a single rotary shaft with a single rotational speed. In order to be able to correctly adhere to the bottle, the applying surface of the lower devices is positioned at a radius which is less than that of the upper devices. As a result, the applying surface of the lower application devices moves with a tangential speed which is less than that of the upper devices.

However, since the differences are not too noticeable, in the most common solutions attempts were made to solve that problem by adjusting the machine for an intermediate speed between those which are optimum respectively for labelling the body and the neck, basically accepting small slipping movements between the labels and the bottles.

Obviously, said solution is not suitable for high quality labelling operations.

In other solutions attempts were made to overcome the problem by modifying the structure of the upper application devices, making them free to oscillate relative to the shaft at the moment of contact against the bottle neck. In this way, when the applying surface makes contact with the bottle, its tangential speed adapts to that of the bottle. An elastic return then causes it to return to the normal position at the end of application.

However, even that solution is not without disadvantages, since due to the elastic movements of the various parts it cannot be used in equipment which has high productivity and therefore a high movement speed.

Examples of the latter type of machines as well as other types of equipment for the simultaneous application of two labels are described in U.S. Pat. No. 4,090,913, DE 2531737, U.S. Pat. No. 4,581,097, U.S. Pat. No. 2,723,042, GB 1080370, GB 952231, GB 814975, U.S. Pat. No. 4,118,269, U.S. Pat. No. 3,116,193, U.S. Pat. No. 2,631,748, DE 1022150, FR 2581363 and FR 2507567.

DISCLOSURE OF THE INVENTION

In this situation the technical purpose which forms the basis of this invention is to provide a unit for the glue application of at least two labels to containers which overcomes the above-mentioned disadvantages.

In particular, this invention has for a technical purpose to provide a unit for the glue application of at least two labels to containers which allows two separate labels to be applied to portions of the same container which are at different distances from the axis of rotation of the unit, without slipping movements between the label and the container and without limits on the productivity of the equipment.

This invention also has for a technical purpose to provide a unit for the glue application of at least two labels to containers which is relatively simple to produce and has compact dimensions.

The technical purpose specified and the aims indicated are substantially achieved by a unit for the glue application of at least two labels to containers as described in the appended claims.

BRIEF DESCRIPTION OF THE DRAWINGS

Further features and the advantages of this invention are more apparent in the detailed description, with reference to the accompanying drawings which illustrate several preferred, non-limiting embodiments of a unit for the glue application of at least two labels to containers, in which.

DETAILED DESCRIPTION OF THE PREFERRED EMBODIMENTS OF THE INVENTION

Figure 1:
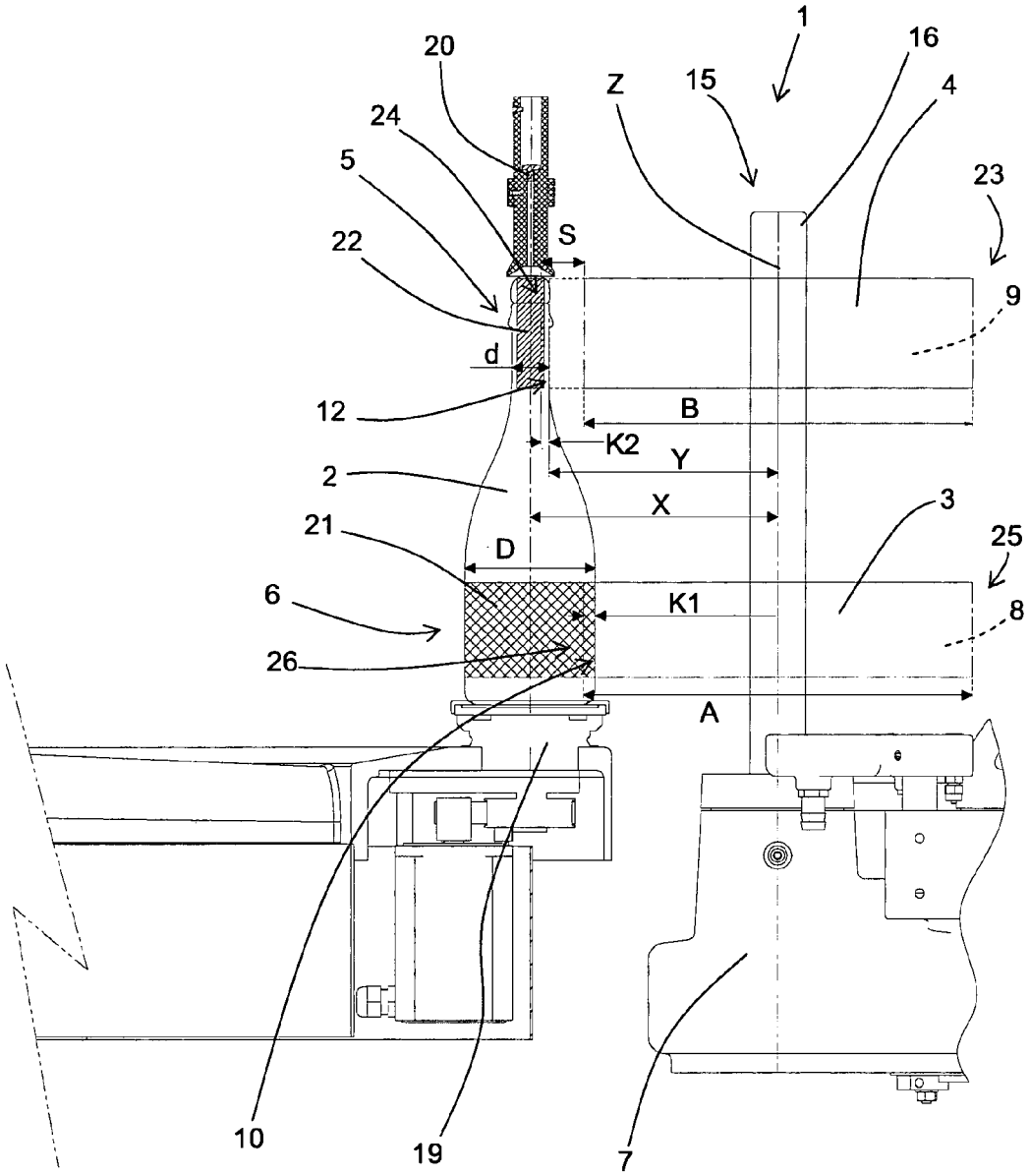
FIG. 1 is a schematic side elevation view of a first embodiment of this invention.

With reference to the accompanying drawings the numeral 1 denotes as a whole a unit for the glue application of at least two labels to containers 2 made in accordance with this invention.

In general, a unit 1 made in accordance with this invention comprises two operating portions, a lower portion 3, intended for example for applying the main label or the rear label to a bottle, and an upper portion 4, intended for example for applying the stamp/neck label or the seal. Both of the portions 3, 4 comprise at least several parts which are mounted in such a way that they can rotate about the same main axis of rotation Z.

Figure 3:
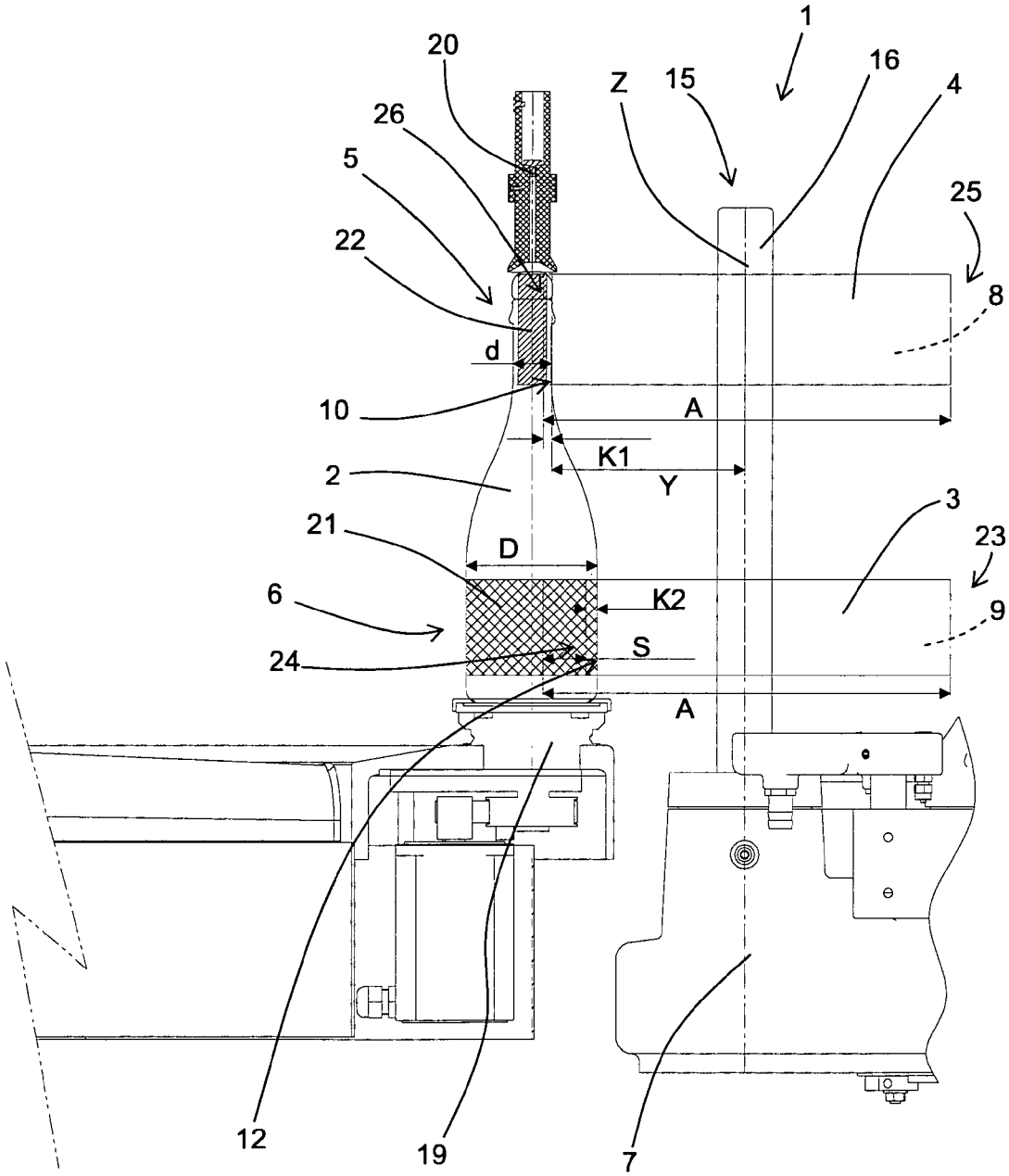
FIG. 3 is a schematic side elevation view of a second embodiment of this invention.

The two portions 3, 4 are schematically illustrated in FIGS. 1 and 3 by two rectangles which indicate their size. All of the other Figures in contrast only show one of the two portions 3, 4, the upper one in FIG. 1, which is also the one to which the innovative part of this invention is applied.

In the preferred embodiment of this invention, one of the two portions 3, 4 is made in the conventional way and the other is made in the innovative way described below.

Figure 2:
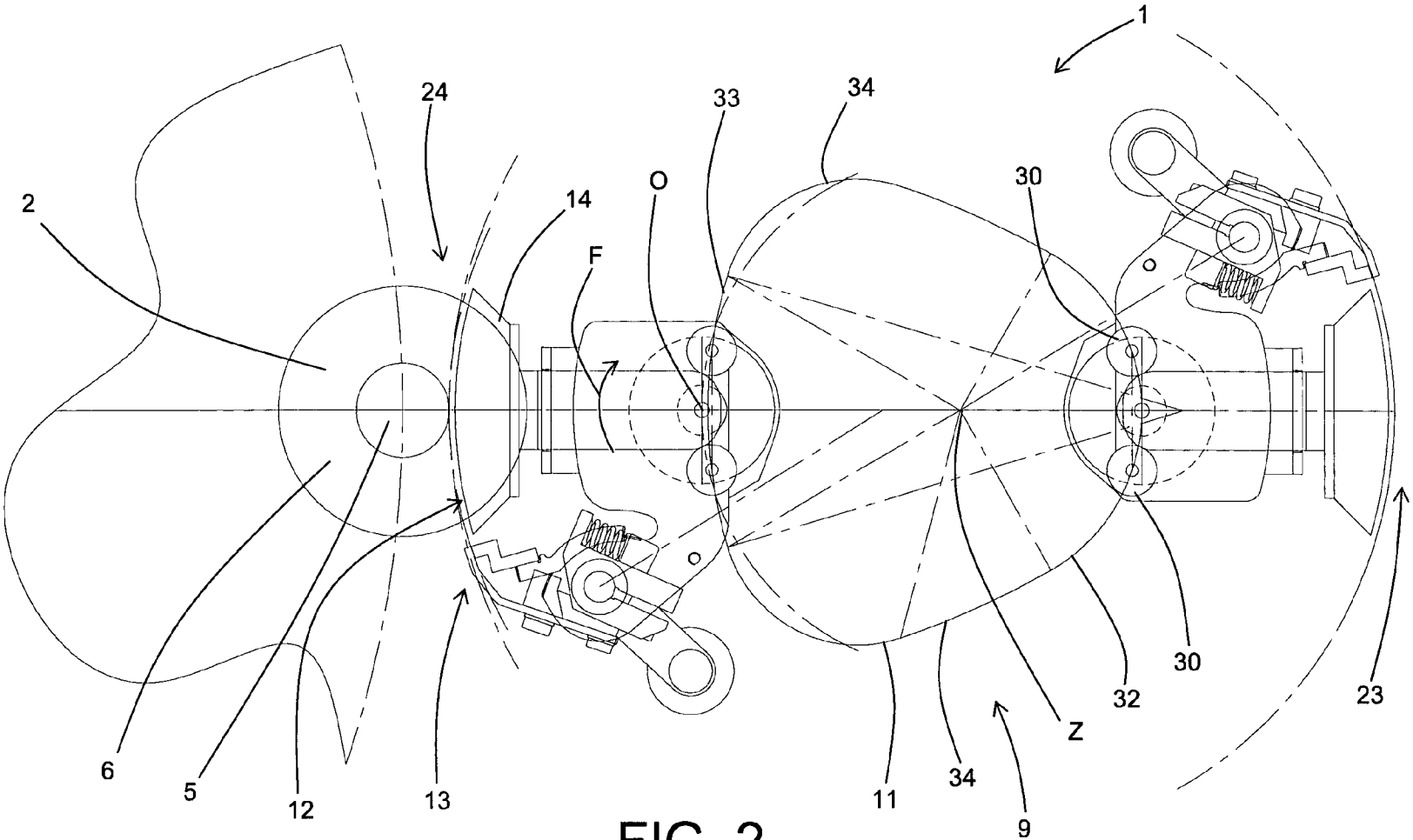
FIG. 2 is a schematic plan view of the first embodiment of this invention.
Figure 4:
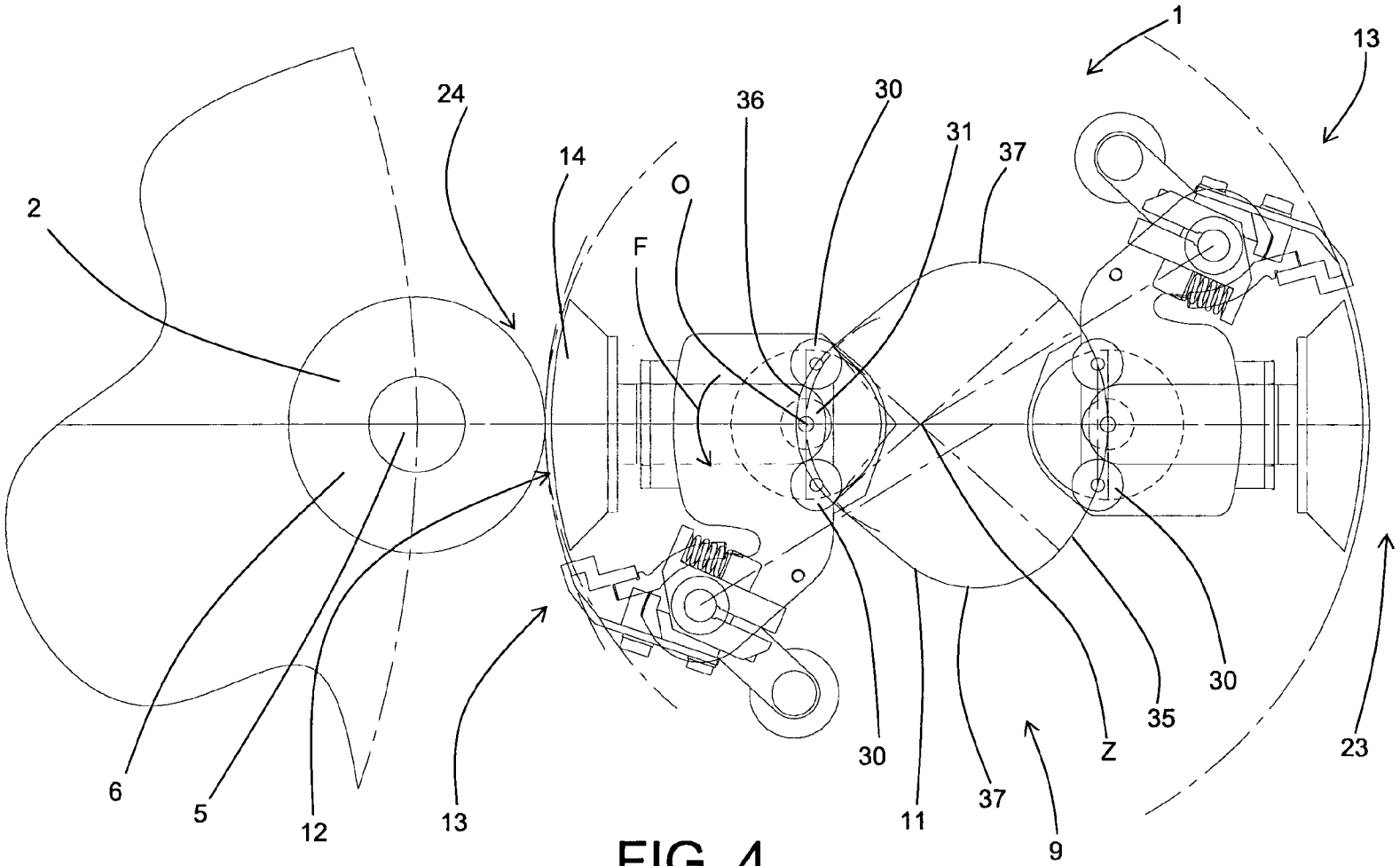
FIG. 4 is a schematic plan view of the second embodiment of this invention.
Figure 6:
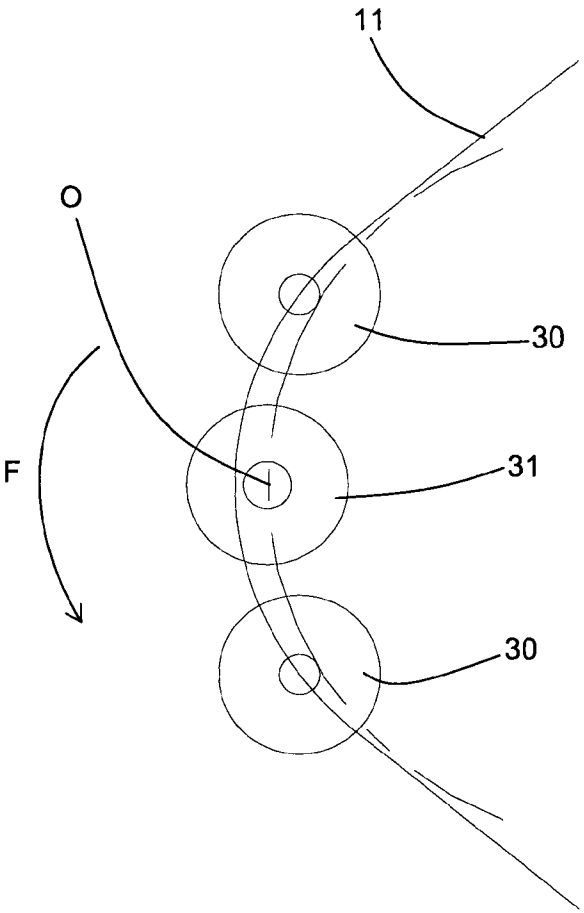
FIG. 6 is an enlarged view of a detail of FIG. 4 with some parts cut away.
Figure 5:
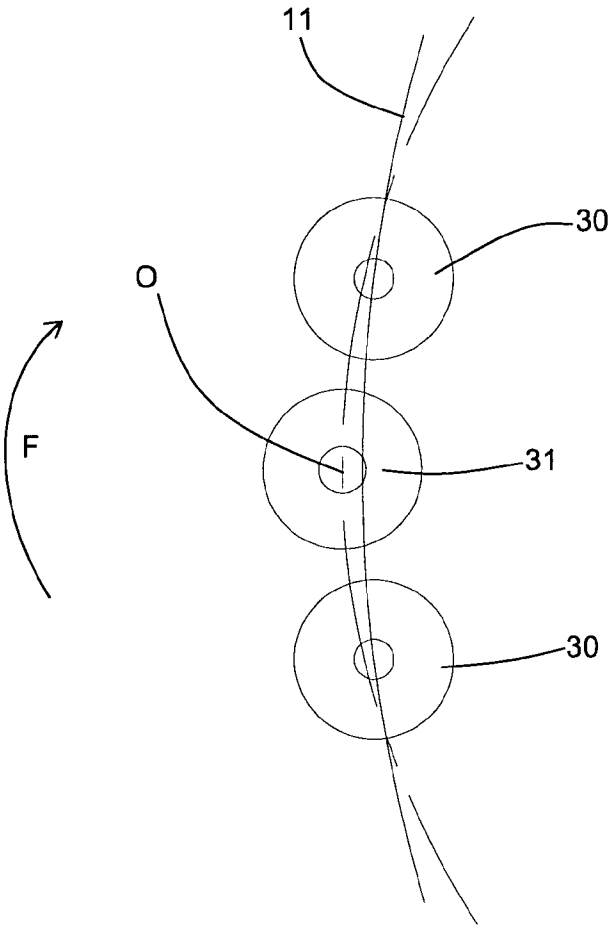
FIG. 5 is an enlarged view of a detail of FIG. 2 with some parts cut away.

In particular, in the embodiment illustrated in FIGS. 1, 2, 5 and from 7 to 21 the portion made in the innovative way is the upper portion (that is to say, the portion intended for applying the label to the neck 5 of the bottle 2), whilst in FIGS. 3, 4 and 6 the portion made in the innovative way is the lower portion (that is to say, the portion intended for applying the label to the body 6 of the bottle 2).

In general, the application unit 1 also comprises first a supporting structure 7 on which at least one first application device 8 and at least one second application device 9 are mounted (two in the accompanying drawings from 7 to 21). Therefore, the first application device 8 and the second application device 9 are positioned at two separate and superposed portions of the main axis of rotation Z, each for applying at least one label on a separate portion of the same container 2.

With reference to FIGS. 1 and 3, the first application device and the second application device 9 belong one to the lower operating portion 3, and the other to the upper operating portion 4. In particular, in the embodiment in FIG. 1 the first application device 8 is part of the lower portion 3, whilst in the embodiment in FIG. 3 it is part of the upper portion 4.

The first application device 8 is a conventional application device which therefore is not described in detail herein. It is rotatably mounted on the supporting structure 7 for rotating about a main axis of rotation Z and therefore cyclically passing between a first label pickup position 25 and a first position 26 for label application to a container 2.

In particular, the first application device 8 moves along a first trajectory which, at least at the first application position 26, is circular and centred on the main axis of rotation Z. However, advantageously, the entire first trajectory consists of a single circle centred on the main axis of rotation Z.

In the known way, the first application device 8 also comprises at least a first applying surface 10 which in practice is intended to be pressed against the surface of the container 2 to be labelled and on which a label can be retained. Advantageously, the first applying surface 10 may be formed by a pad of elastically deformable material (for example, a sponge) which is pressed against the container 2 to be labelled in order to guarantee correct application of the label to the container 2. Moreover, the first application device 8 may be equipped with suitable means for retaining the label on the pad (such as grippers).

For example, the retaining means and the pad may have the same structure as the corresponding retaining means and pad described below with reference to the second application device 9.

Also in the known way, the label which arrives at the first pickup position 25 already has glue put on it.

First rotation means then move the first application device 8 along the first trajectory with a first rotational speed relative to the main axis of rotation Z which may be either constant or variable, depending on requirements.

As already indicated, the unit 1 comprises at least one second application device 9 which in turn is rotatably mounted on the supporting structure 7 and which also rotates about the main axis of rotation Z but along a second trajectory 11 which, as described in more detail below, is not a circle centred on the main axis of rotation Z.

Similarly to the first device, the second application device 9 therefore also cyclically passes between a second label pickup position 23 and a second label application position 24.

Again, the label to be picked up already has glue put on it.

As already indicated, the second application device 9 comprises at least a second applying surface 12 intended to be pressed against the surface of the container 2 to be labelled and on which a label can be retained by suitable retaining means 13 (described below). Moreover, advantageously, the second applying surface 12 is also formed by a pad 14 made of elastically deformable material (such as a sponge) which in practice is pressed against the container 2 to be labelled in order to precisely press the label against it.

It should be noticed that if the first or the second applying surface 10, 12 is formed by an elastically deformable element which in practice is pressed against the container 2, where hereinafter reference is made to the operating position (the position in practice) of the first applying surface 10 or the second applying surface 12, it shall preferably mean the position that said surfaces adopt once the pad 14 has been pressed against the container 2.

Second rotation means 15 move the second application device 9 along the second trajectory 11 with a second rotational speed relative to the main axis of rotation Z.

However, in accordance with this invention, the second rotational speed is identical to the first rotational speed. In other words, relative to the main axis of rotation Z, the first and second application devices 8, 9 rotate with the same instantaneous rotational speed.

In the preferred embodiment this is achieved by using a single supporting shaft 16 rotatably mounted on the supporting structure 7 and on which both the first application device 8 and the second application device 9 are mounted (FIGS. 1 and 3) and which therefore forms both the first and the second rotation means 15.

In the Figures from 7 onwards, the only part of the shaft 16 visible is an outer jacket 17 in which a hole 18 is made in which a motor-driven driving element is inserted. The supporting shaft 16 therefore rotates about the main axis of rotation Z and produces the first and the second rotational speeds.

Moreover, as described in more detail below, the second application device 9 is preferably slidably mounted on the supporting shaft 16 in such a way that it can move radially relative to the main axis of rotation Z.

The first application device 8, in the embodiments illustrated, is advantageously stationary relative to the main axis of rotation Z, in the sense that it cannot move radially relative to the latter. However, that does not rule out the possibility that in other embodiments the first application device 8 may also move radially relative to the main axis of rotation Z.

FIGS. 1 and 3 show a bottle 2 positioned on a plate 19 of a labelling machine rotary carrousel, at a label application unit 1 made in accordance with this invention. The upper part of the bottle 2 is retained by a suitable retaining element 20 which is also integral with the carrousel. On the bottle 2, rotated through 90° towards the observer for clarity, the two labels which the unit 1 is designed to apply are shown (in this case a main label 21 and a seal 22). The larger diameter D of the bottle 2 at the body and its smaller diameter d at the neck 5 are also indicated. As regards the application unit 1, the observer can see labelled A, B the diameters of the cylinder which respectively the first application device and the second application device 9 would describe if their distance from the main axis of rotation Z were always the same (that of the first application device 8), the compression K1 of the pad 14 belonging to the first application device 8, the radial movement S of the second applying surface 12 relative to the position of the first applying surface 10, the compression K2 of the pad 14 belonging to the second application device 9, the distances X, Y from the main axis of rotation Z respectively of the axis of the bottle 2 and of the surface of the bottle 2 neck 5.

It should be noticed that the radial movement S is the movement which the second device must perform in order to compensate for the difference between the larger diameter D and the smaller diameter d of the bottle 2.

According to this invention, in practice at least at the second application position 24 the second applying surface 12 is at a distance from the main axis of rotation Z which is different to the distance between the main axis of rotation Z and the first applying surface 10 located in its first application position 26. In particular, the distance of the second applying surface 12 is less than that of the first when the first application device and the second application device 9 are intended to apply the labels respectively on the neck 5 and on the body 6 of the bottle 2. In contrast, the distance of the second applying surface 12 is greater than that of the first when the first application device and the second application device 9 are intended to apply the labels respectively on the body 6 and on the neck 5 of the bottle 2. In other words, when the device for applying the label on the body is held stationary, the other device must be moved outwards so that it can reach the surface of the neck 5 (FIG. 1). In contrast, when the device for applying the label on the neck 5 is held stationary, the other device must be moved inwards so that it can reach the surface of the body 6 (FIG. 1).

The need for radial movement of the second application device 9 is linked to the fact that it is advantageous if at the pickup position and glue spreading means, the first applying surface and the second applying surface 12 are at the same distance from the main axis of rotation Z (in this way, the tangential speeds are the same and the unit 1 is easier to control).

In the embodiments illustrated this is achieved by mounting the second application device 9 on a slide 27 which is slidably connected to a rail-shaped arm 28, integral with the supporting shaft 16 and extending radially relative to the main axis of rotation Z.

Moreover, in accordance with this invention, the second application device 9 pivots about an axis of oscillation O rotating about the main axis of rotation Z with the second rotational speed.

In the embodiments illustrated this is achieved by pivoting the second application device 9 relative to the slide 27 which can move radially.

In accordance with this invention, the second application device 9 is made in such a way that the second applying surface 12 moves about the second application position 24 with a tangential speed which is greater than or less than that of the first applying surface 10, depending whether the first applying surface 10 is respectively closer to or further from the main axis of rotation Z than the second applying surface 12.

Advantageously, this is achieved thanks to a first guide element 29 (which at least in practice is stationary relative to the supporting structure 7) and to two first follower elements 30. The latter are part of the second application device 9 and are slidably connected to the first guide element 29 so that they can follow its course during rotation of the second application device 9 about the main axis of rotation Z.

Figure 13:
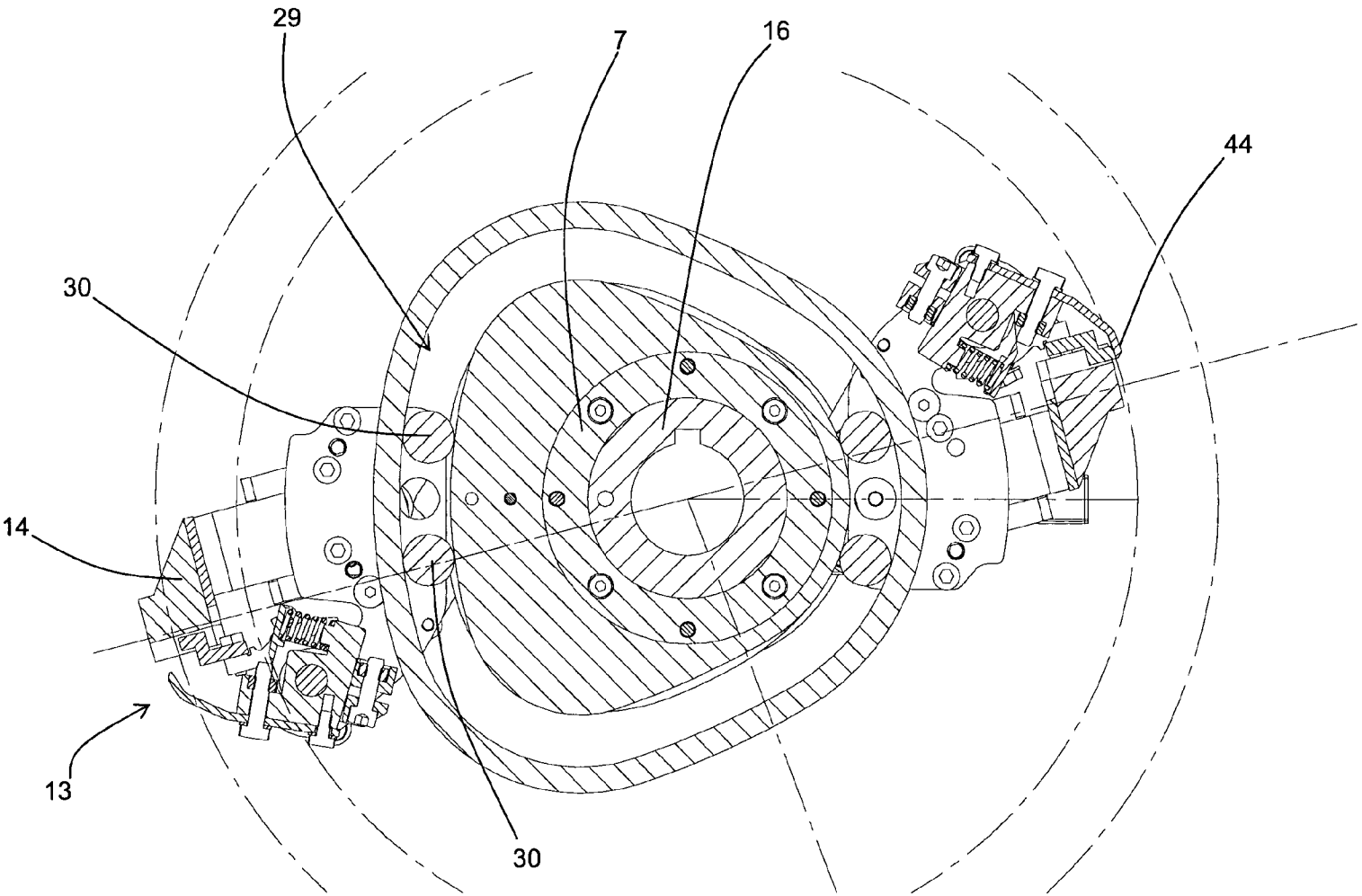
FIG. 13 shows the part of the unit of FIG. 9 according to the line XIII-XIII from FIG. 10.

In FIG. 13, the first guide element 29 is a race whose width matches those of the first follower elements 30 (which may for example be rollers or pins), which are in turn inserted in the race and spaced out from each other along the race.

The interaction between the first follower elements 30 and the first guide element 29 produces the second trajectory 11 for movement of the second application device 9, that is to say, both its radial position relative to the main axis of rotation Z and its rotation relative to the axis of oscillation O.

Moreover, also according to this invention, at least at the stretch of the second trajectory 11 for movement which produces transit of the second application device 9 close to and at the second application position 24, the interaction between the first follower elements 30 and the first guide element 29 causes a controlled rotation of the second application device 9 about the axis of oscillation O. In particular, said rotation occurs in such a way that the second applying surface 12 rotates either in the same direction or in the opposite direction to the direction of rotation of the second application device 9 about the main axis of rotation Z (relative to the case of only rotation about the main axis of rotation Z with the second rotational speed, in the case of rotation in the same direction the tangential speed of the second applying surface 12 is increased, whilst in the other case it is reduced). Advantageously, this rotation is in the same direction if, in practice, at the second application position 24 the second applying surface 12 is at a distance from the main axis of rotation Z which is less than the distance between the main axis of rotation Z and the first applying surface 10 located in its first application position 26. In contrast, it is in the opposite direction if, in practice, at the second application position 24 the second applying surface 12 is at a distance from the main axis of rotation Z which is greater than the distance between the main axis of rotation Z and the first applying surface 10 located in its first application position 26.

The direction of rotation of the second applying surface 12 about the axis of oscillation O is indicated by the arrows F in FIGS. 2, 4, 5 and 6.

Advantageously, in the embodiments illustrated the stretch of the second trajectory 11 for movement of the second application device 9, which corresponds to the zone around the second application position 24, is formed by a portion of the first guide element 29 having the shape of a circular arc. Said arc is centred on an axis of instantaneous rotation which is parallel with the main axis of rotation Z and has a radius greater than or less than the distance between the axis of oscillation O and the main axis of rotation Z. In particular, the radius is less than the distance between the axis of oscillation O and the main axis of rotation Z if, in practice, at the second application position 24 the second applying surface 12 is at a distance from the main axis of rotation Z which is less than the distance between the main axis of rotation Z and the first applying surface 10 located in its first application position 26. In contrast, it is greater if, in practice, at the second application position 24 the second applying surface 12 is at a distance from the main axis of rotation Z which is greater than the distance between the main axis of rotation Z and the first applying surface 10 located in its first application position 26.

FIGS. 5 and 6 schematically illustrate that situation. Said Figures show the pin 31 used for pivoting the second application device 9 at the slide 27 (whose centre identifies the axis of oscillation O), the two first follower elements 30, and with a continuous line the second trajectory 11 for movement of the two first follower elements 30, and with a long dash-short dash line the circle passing through the axis of oscillation O centred on the main axis of rotation Z.

FIGS. 2 and 4 show the extension of the second trajectory 11 in the two cases in which, at the second application position 24 the second applying surface 12 is at a distance from the main axis of rotation Z which is greater than (FIG. 2) or less than (FIG. 4) the distance between the main axis of rotation Z and the first applying surface 10 located in its first application position 26.

Said Figures schematically illustrate a bottle 2, two second application devices 9 separated from each other by 180° and the first follower elements 30 and the pin 31 used for pivoting them at the slide 27. In FIG. 2, the second trajectory 11 for movement has a first stretch 32 (the right-hand part) at the pickup position which extends along a circle centred on the main axis of rotation Z, a second stretch 33 (the left-hand side) at the application position which extends as said along a circle having a greater radius, and two curved connecting stretches 34.

In FIG. 4, the stretch 35 at the second pickup position 23 is the same as in the other case, whilst the stretch 36 at the second application position 24 has a much smaller radius. The other stretches 37 are only connecting stretches. Moreover, in both Figures, the long dash-short dash lines only indicate reference circles and lines.

Moreover, advantageously at least at the pickup positions the first applying surface 10 and the second applying surface 12 are at the same distance from the main axis of rotation Z (in other words the first trajectory and the second trajectory 11 for movement coincide).

In the embodiment illustrated in FIGS. 7 to 21, at least the second application device 9 comprises means 38 for further pushing the second applying surface 12 outwards at least at the second application position 24, for increasing the pressure applied on the label and avoiding interference between the label retaining means 13 and the container 2.

Figure 11:
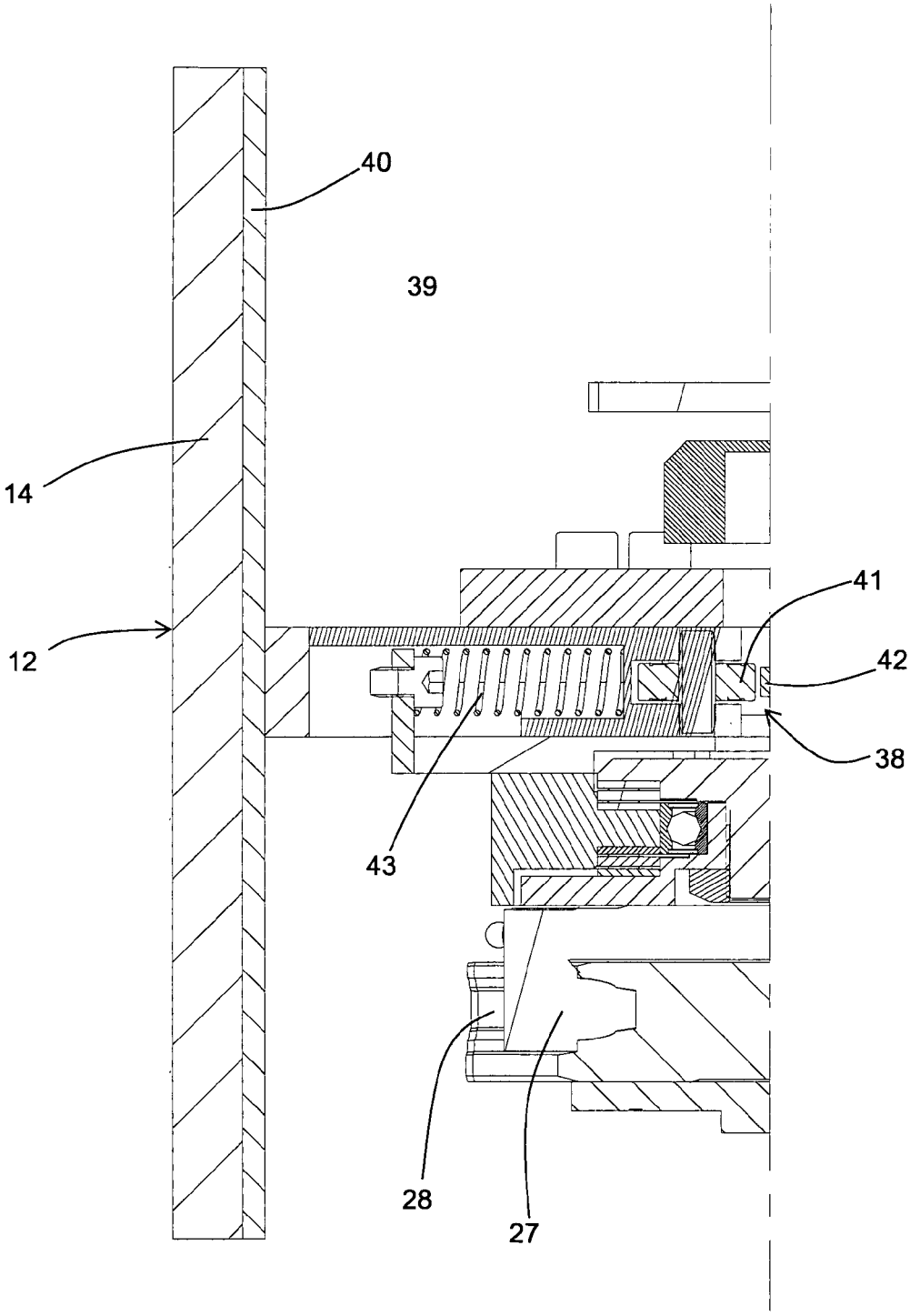
FIG. 11 is a cross-section of the part of the unit of FIG. 9 according to the line XI-XI.

In particular, the pushing means 38 comprise a horizontal bar 39 bearing at one end a plate 40 to which the pad 14 is fixed which forms the second applying surface 12. At the other end the bar is integral with a second follower element 41 (such as a roller) which is operatively coupled with a second guide element 42 integral with the supporting structure 7. A spring 43 opposes the outward movement of the bar 39, keeping the second follower element 41 in contact with the second guide element 42 (FIG. 11).

Figure 12:
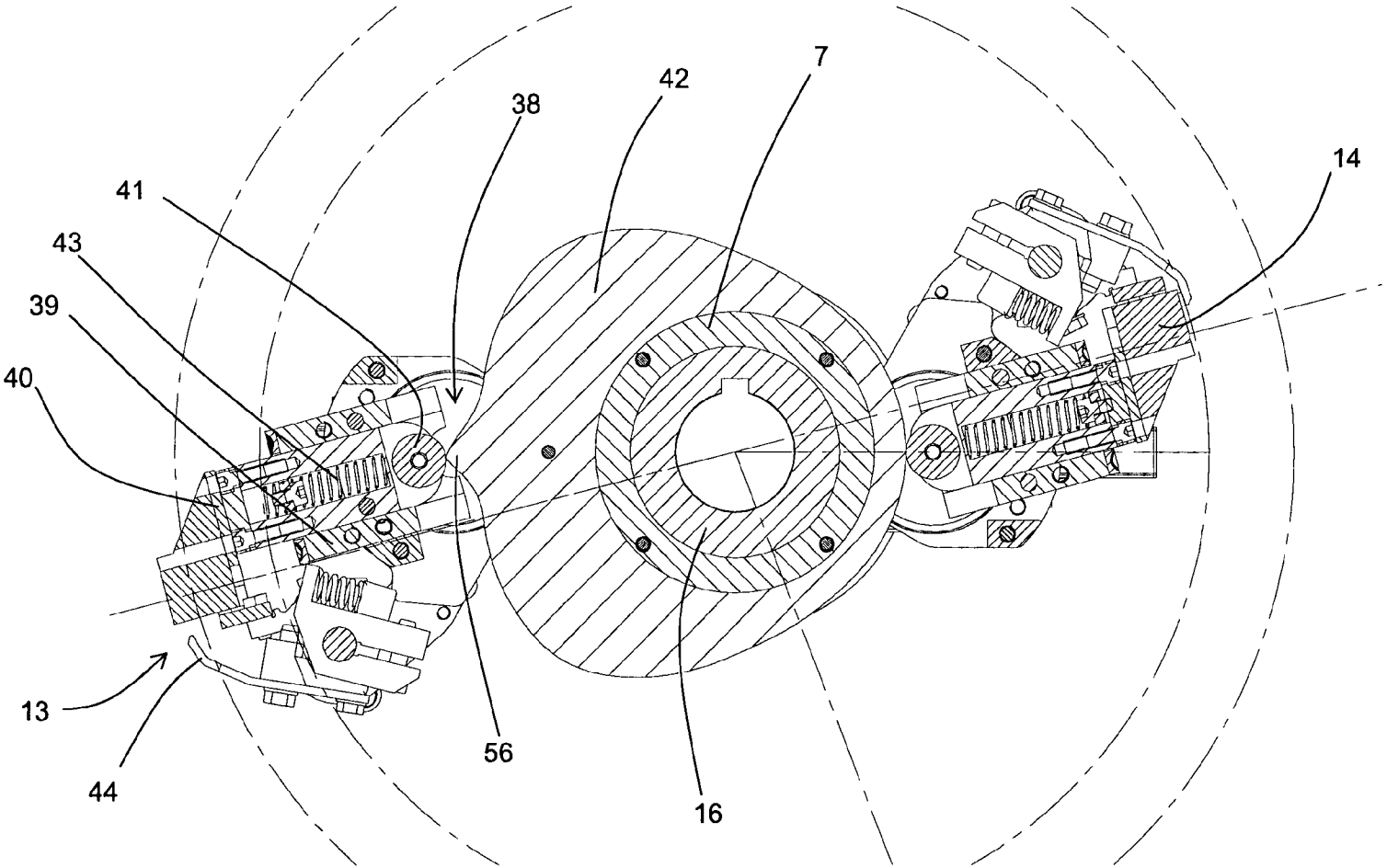
FIG. 12 shows the part of the unit of FIG. 9 according to the line XII-XII from FIG. 10.

As shown in FIG. 12, the profile of the second guide element 42 corresponds to that of the first guide element 29, except for the fact that the second guide element 42 has a tooth 56 at the second application position 24, the tooth 56 causing the second applying surface 12 to be pushed outwards (or, in other words, pad 14 pressure against the surface of the container 2). Consequently, the interaction between the second follower element 41 and the second guide element 42 causes the second applying surface 12 to be moved outwards at least at the second application position 24.

As already indicated, advantageously the first application device 8 and the second application device 9 also comprise respective retaining means 13 for retaining the label on the respective applying surface at least during the device passage from the pickup position to the application position.

Figure 7:
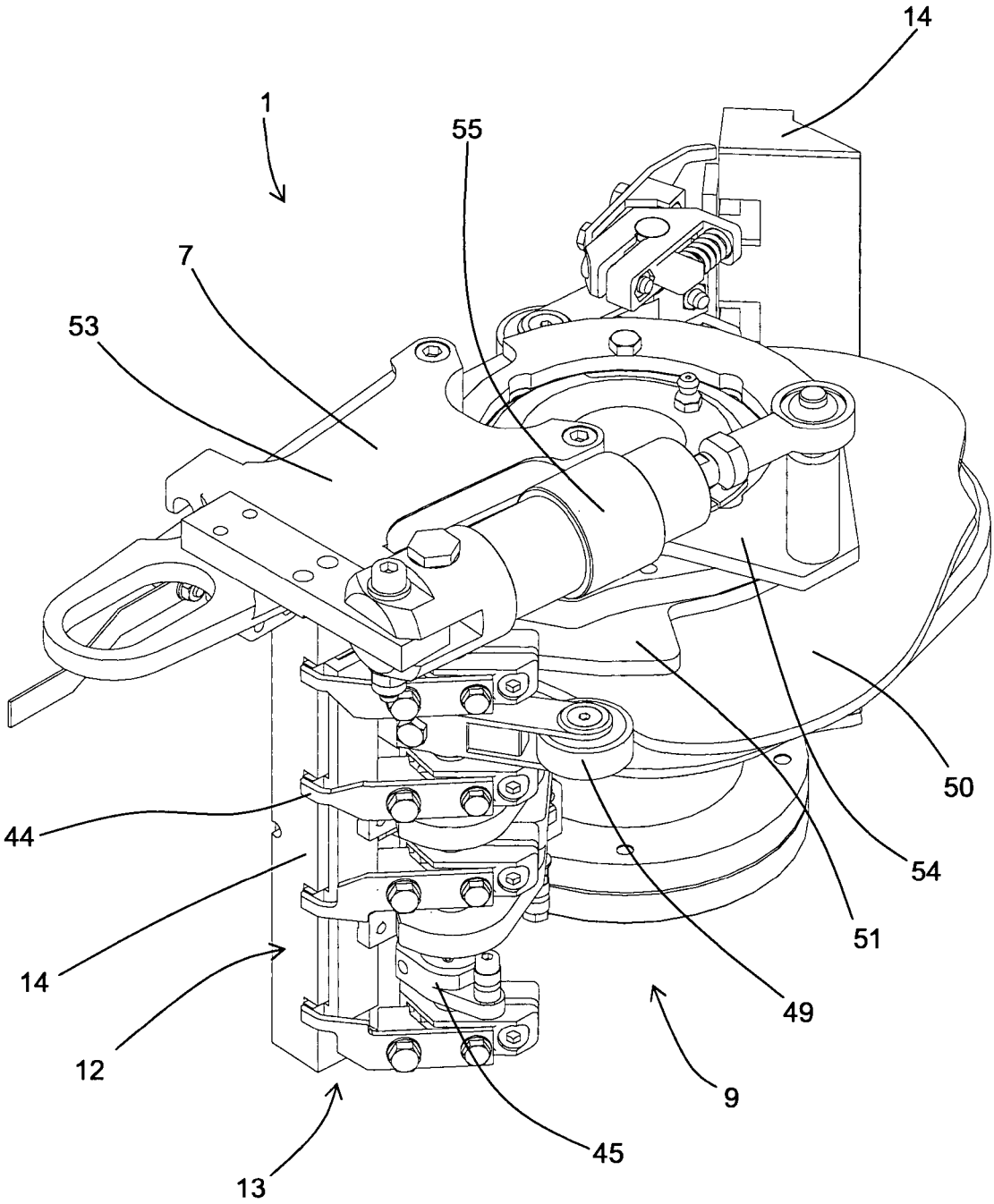
FIG. 7 is an axonometric top view of an upper part of a labelling unit made in accordance with the first embodiment of this invention.
Figure 8:
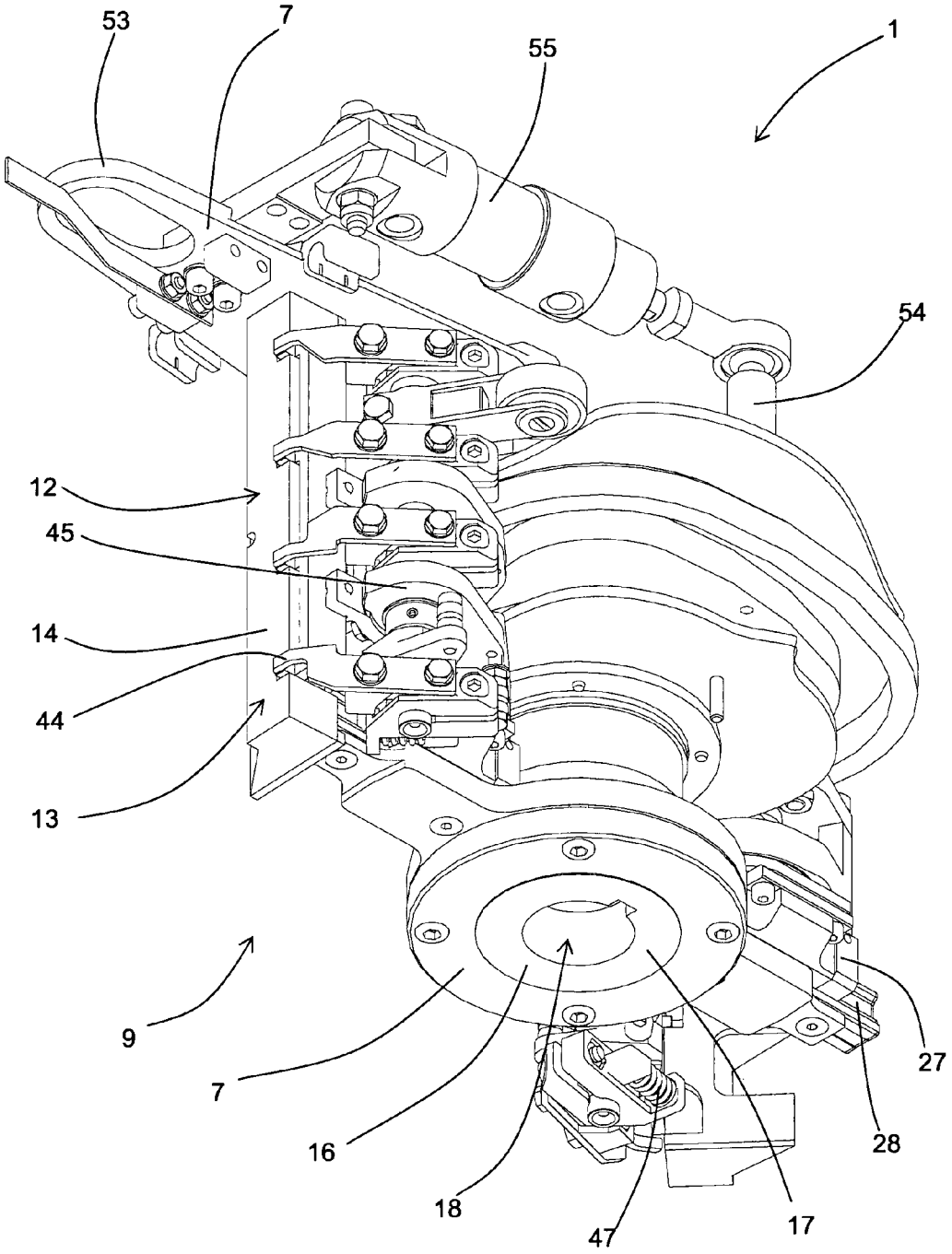
FIG. 8 is an axonometric bottom view of the part of the unit of FIG. 7.
Figure 14:
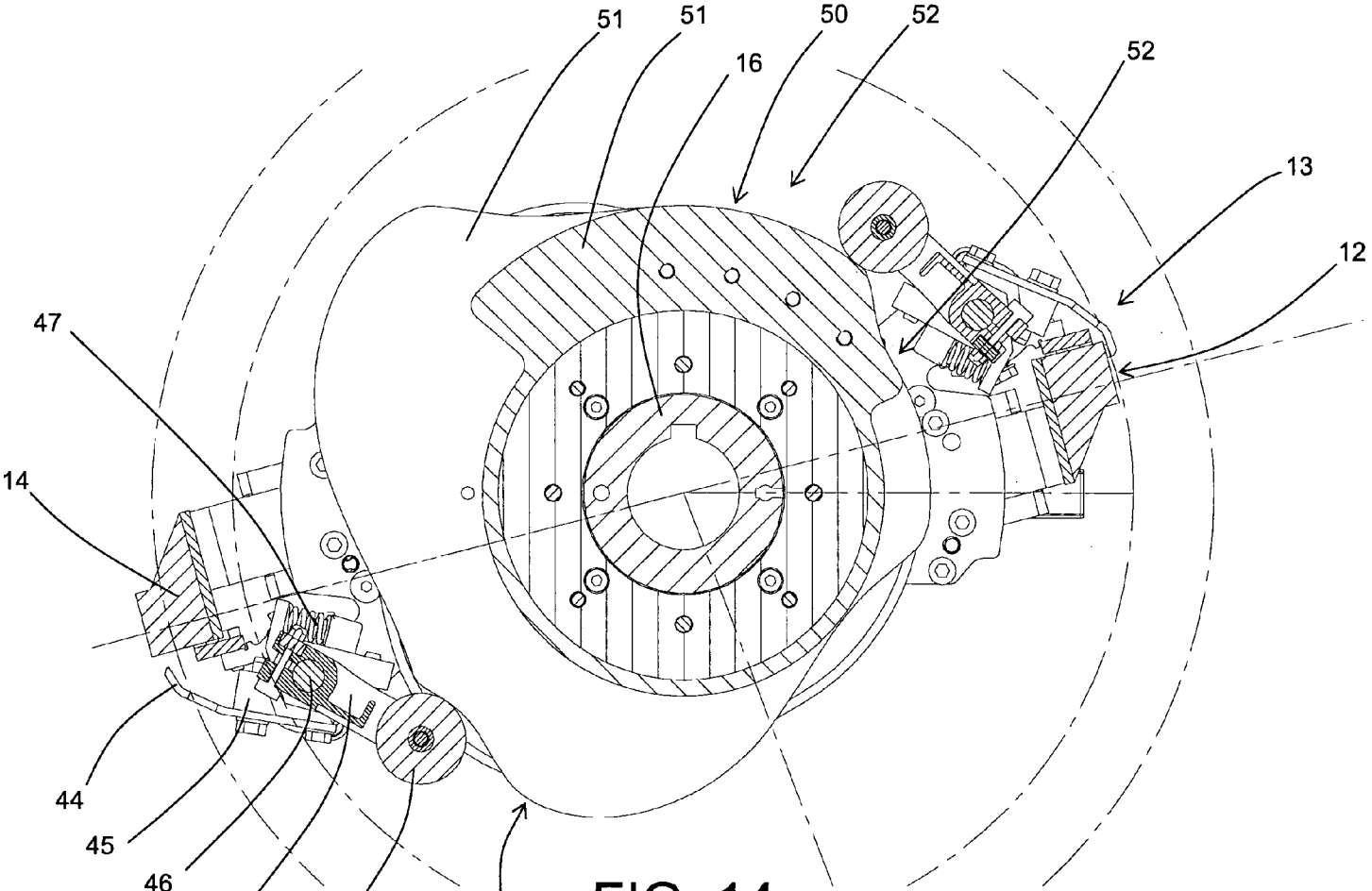
FIG. 14 shows the part of the unit of FIG. 9 according to the line XIV-XIV from FIG. 10.
Figure 15:
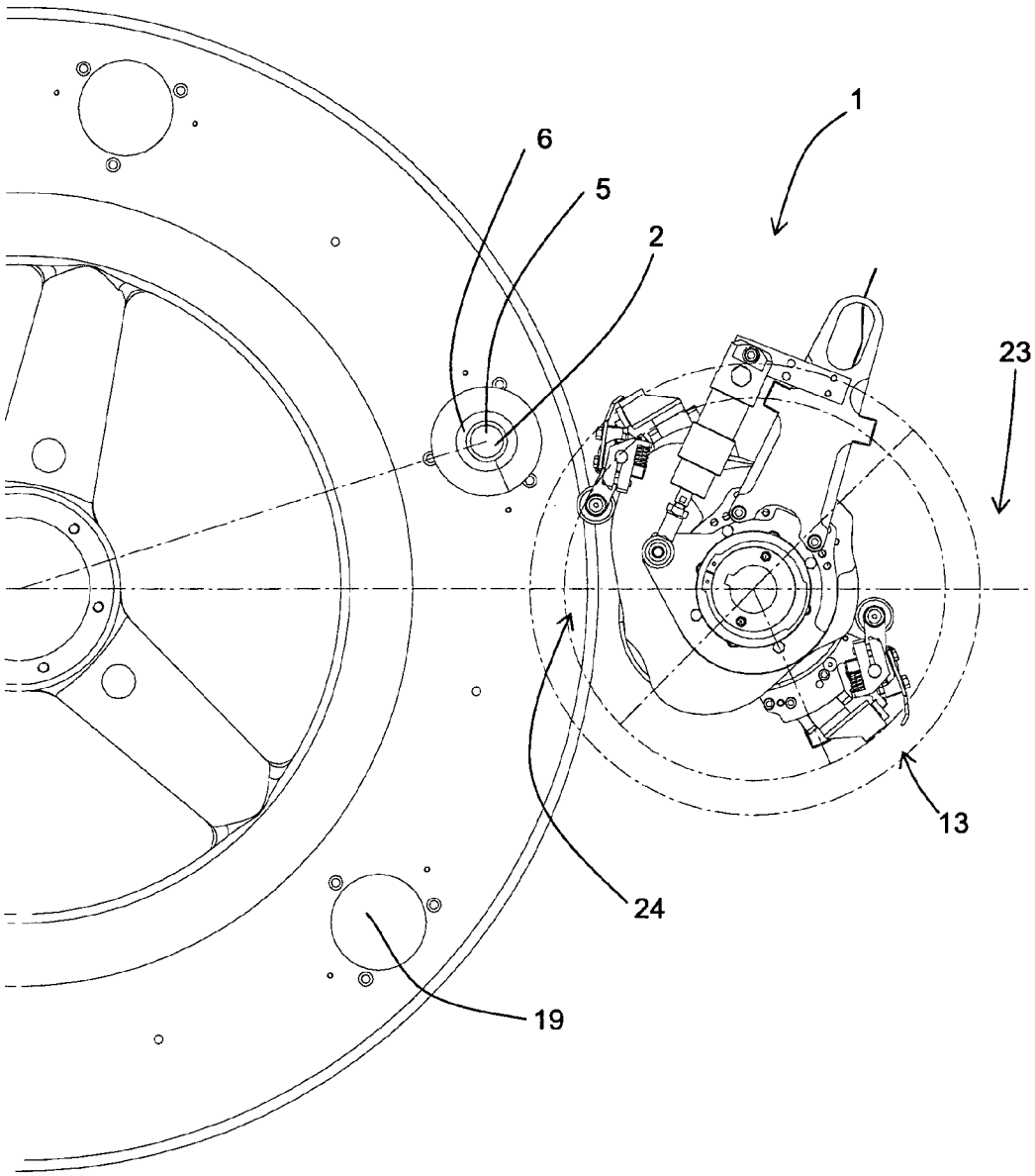
FIGS. 15 to 21 show the sequence of steps which result in a label being applied to the neck of a bottle by means of the part of the unit of FIGS. 7 to 14.
Figure 16:
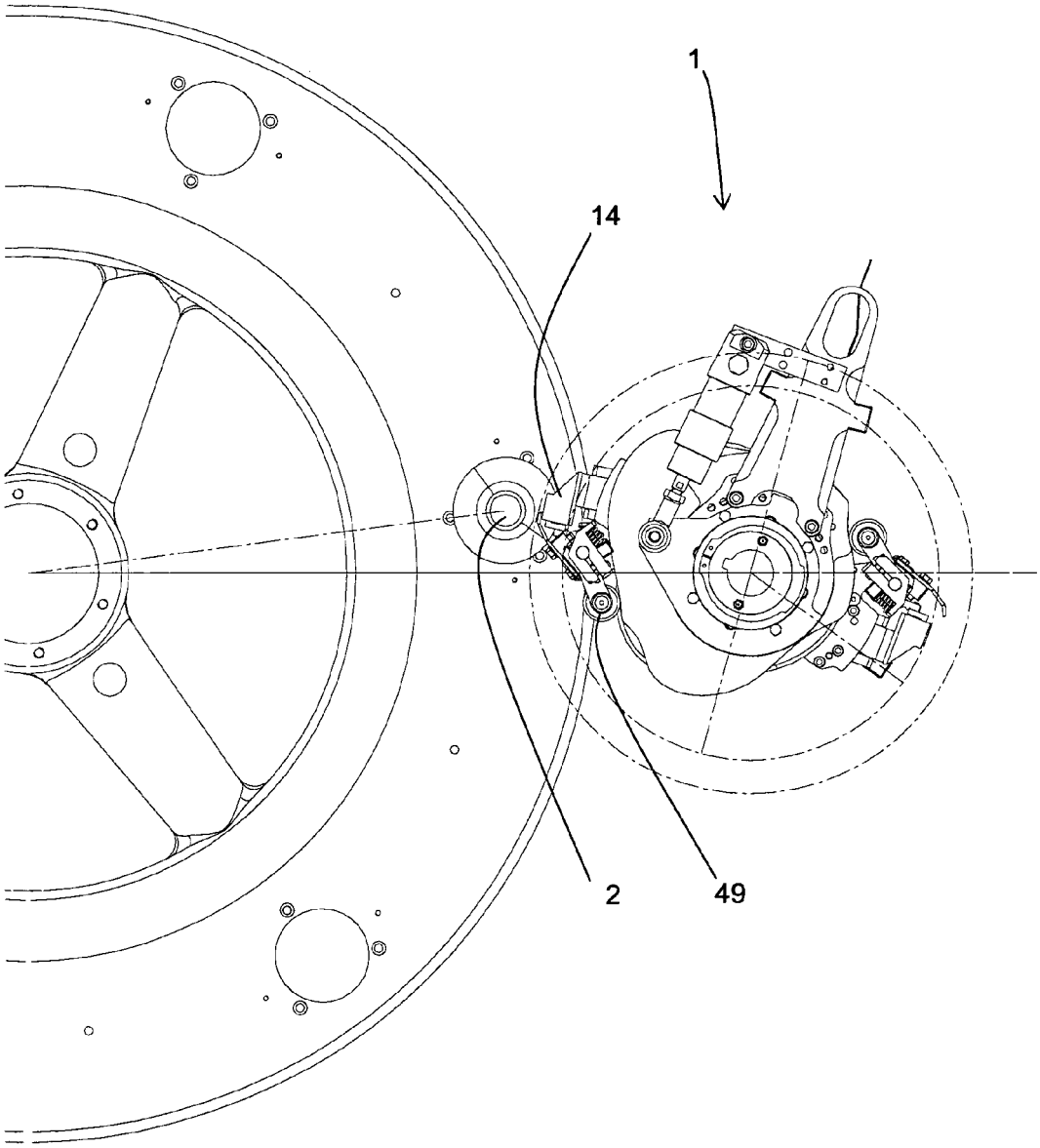
Figure 17:
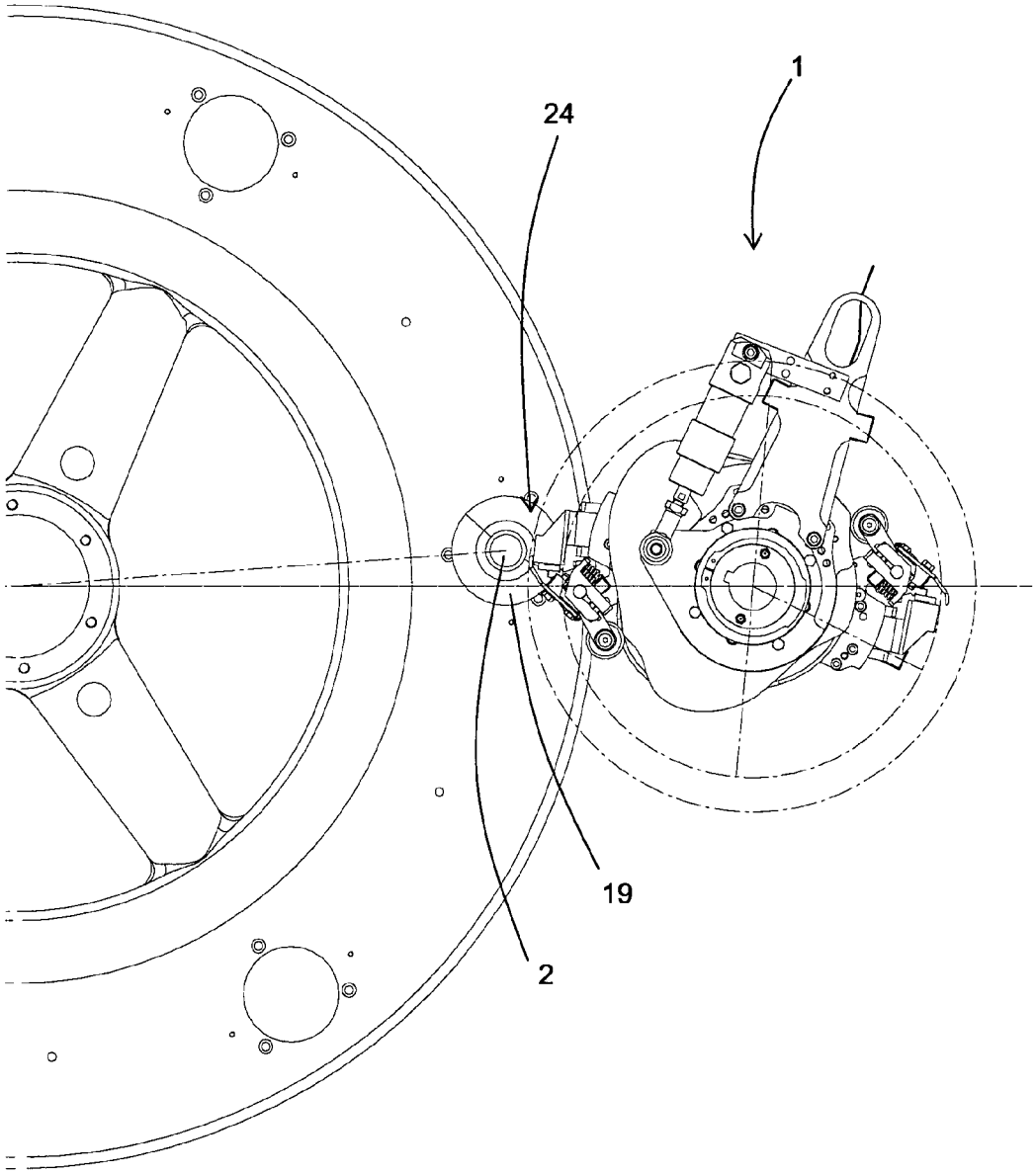
Figure 18:
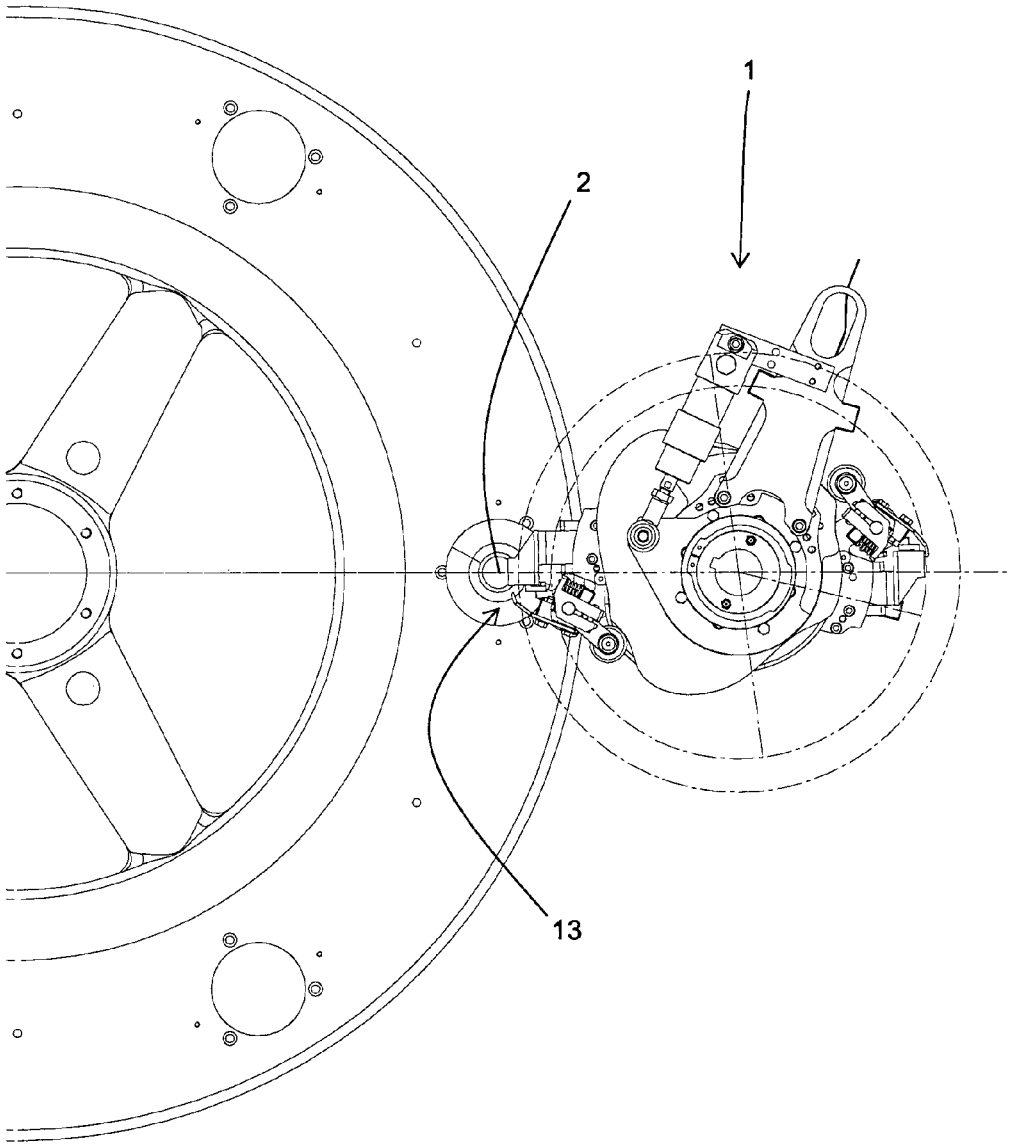
Figure 19:
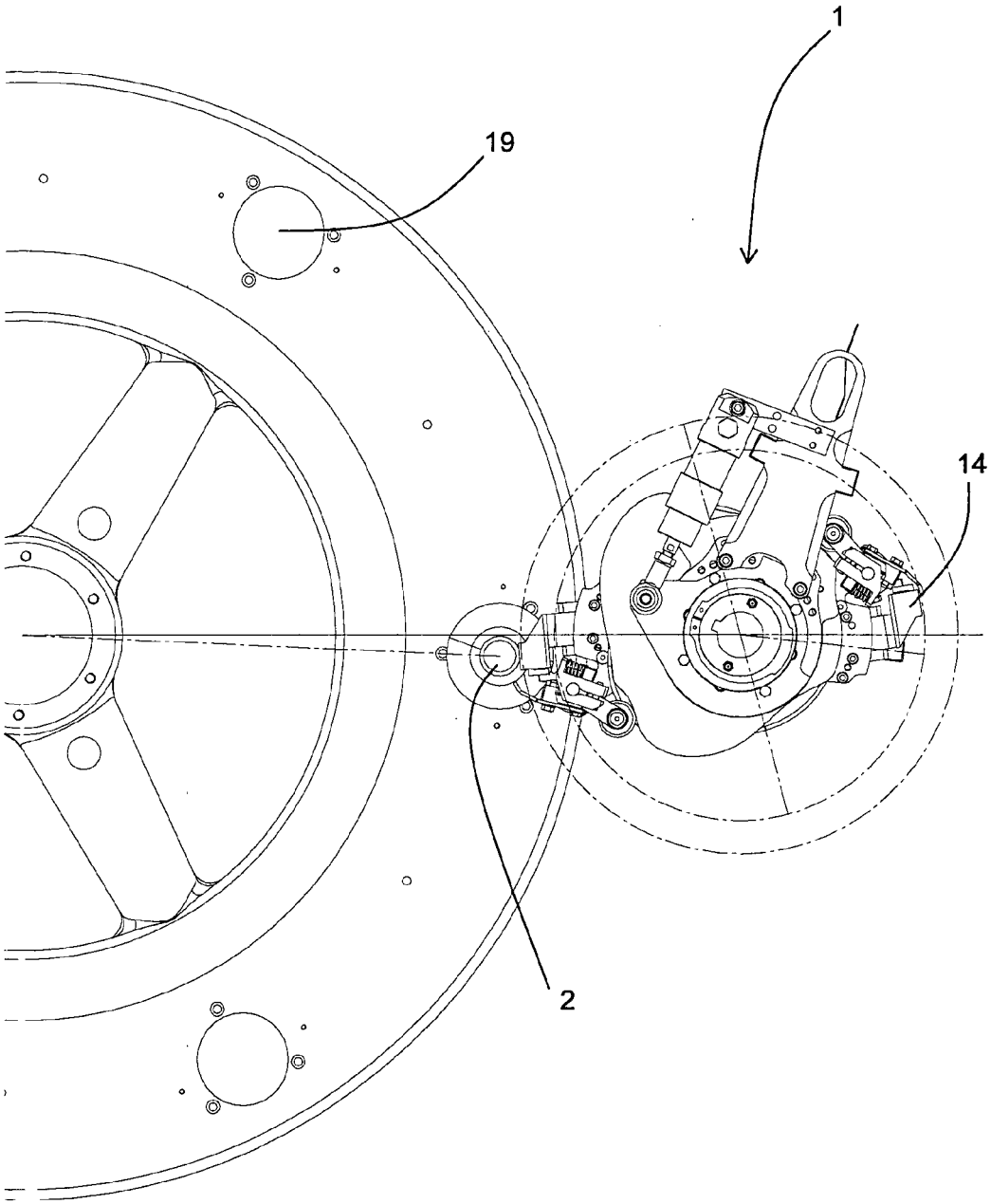
Figure 20:
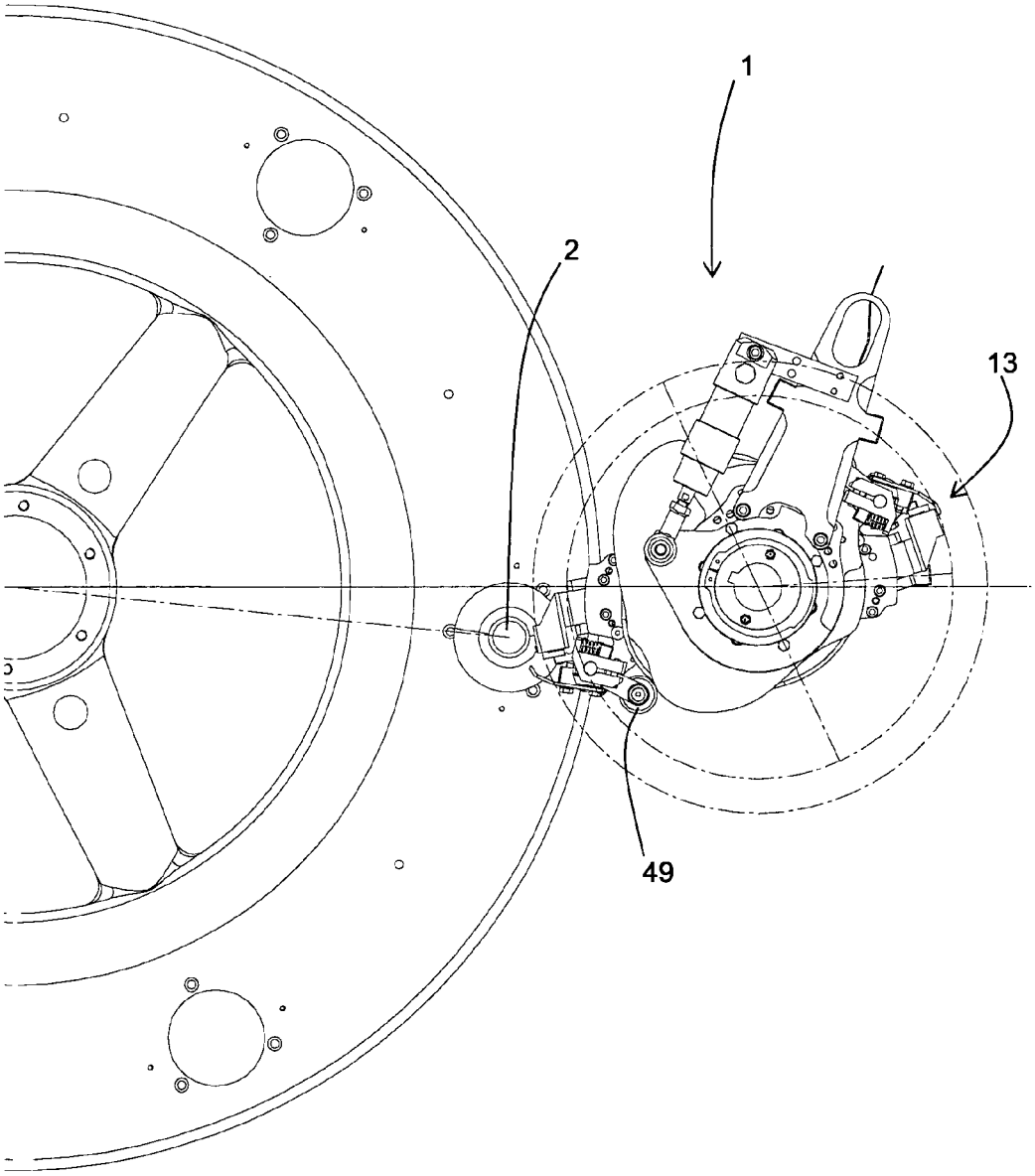
Figure 21:
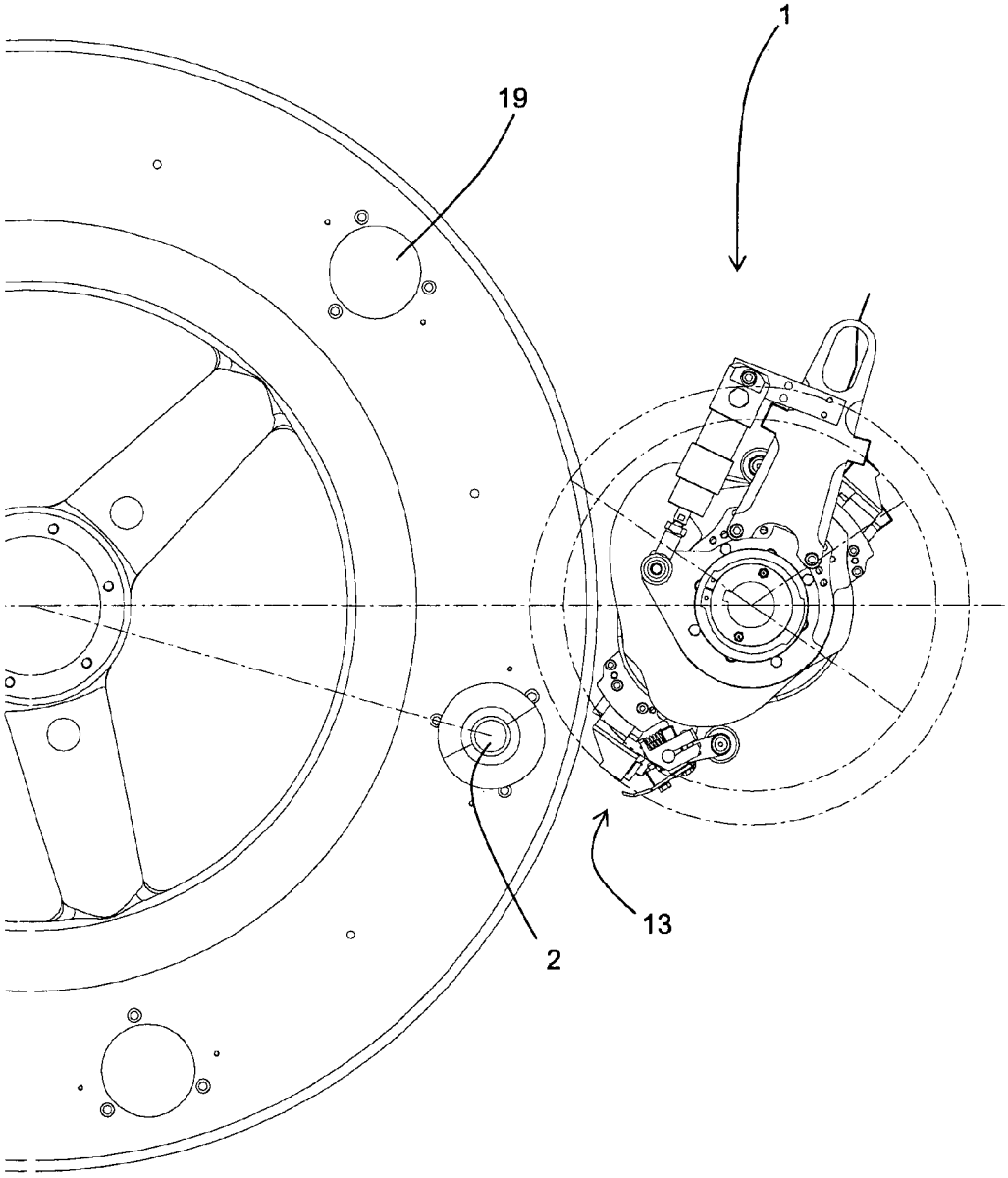

The retaining means 13 of the second application device 9 illustrated are visible in FIGS. 7, 8 and 14. Advantageously, they comprise a plurality of mobile prongs 44 each forming a gripper with a portion of the pad 14 supporting plate 40 (FIG. 7 shows how the pad 14 is shaped so that it is not present at the mobile prongs 44). All of the prongs 44 are rigidly fixed together to form a rigid body 45 pivoting about a hinge shaft 46 which is integral with the second application device 9. Mounted between the rigid body 45 and the rest of the application device 9 there are springs 47 which push the mobile prongs 44 towards the closed position illustrated in the front part of FIGS. 7 and 8 (or on the right in FIG. 14). Also rigidly connected to the rigid body 45 there is a rod 48 bearing a roller 49 at one end, which thanks to the action of the spring 47 is pushed against a third guide element 50 integral with the supporting structure 7. This third guide element 50, visible in FIG. 14, actually comprises two superposed shaped plates 51 whose thickness is such that the roller rolls on the one which out of the two at each point projects radially the most. Moreover, said plates 51 have two connecting zones 52 for the respective outer surfaces which guarantee the connection between the two for a predetermined angle of reciprocal rotation. When setting up the unit 1, by rotating the two plates 51 relative to one another it is possible to optimise operation of the retaining means 13.

Moreover, the profile of the plates 51 is made in such a way that it forces the grippers to open at the application and pickup stations, by means of a forced rotation of the rigid body 45 about the hinge shaft 46, overcoming the force applied by the springs 47.

In evaluating the shape of the profile it should be considered that it must be interpreted together with those of the first guide element 29 and the second guide element 42 which cause the movement in space of the second application device 9 and therefore of the hinge shaft 46.

Figure 9:
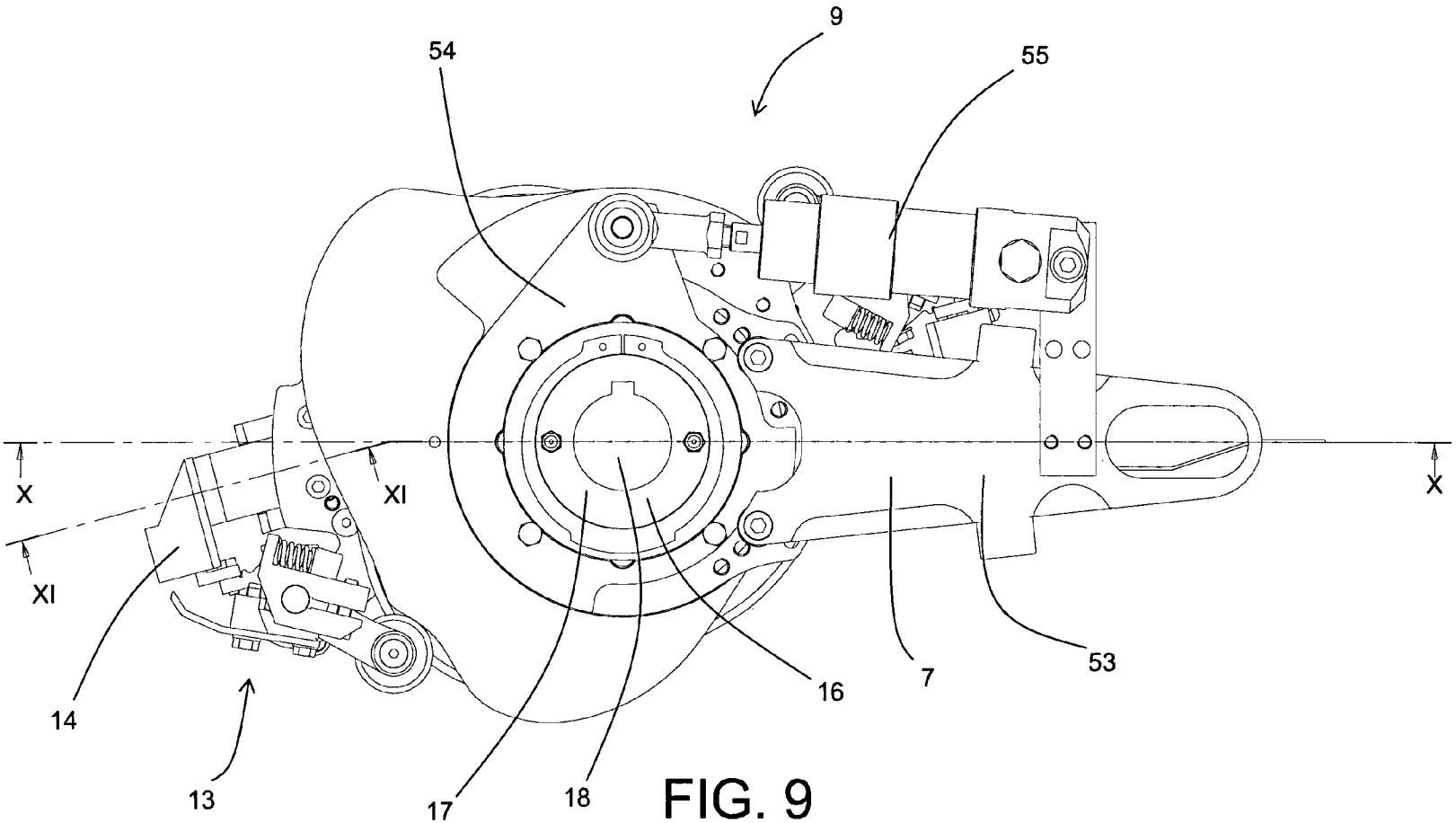
FIG. 9 is a top view of the part of the unit of FIG. 7.
Figure 10:
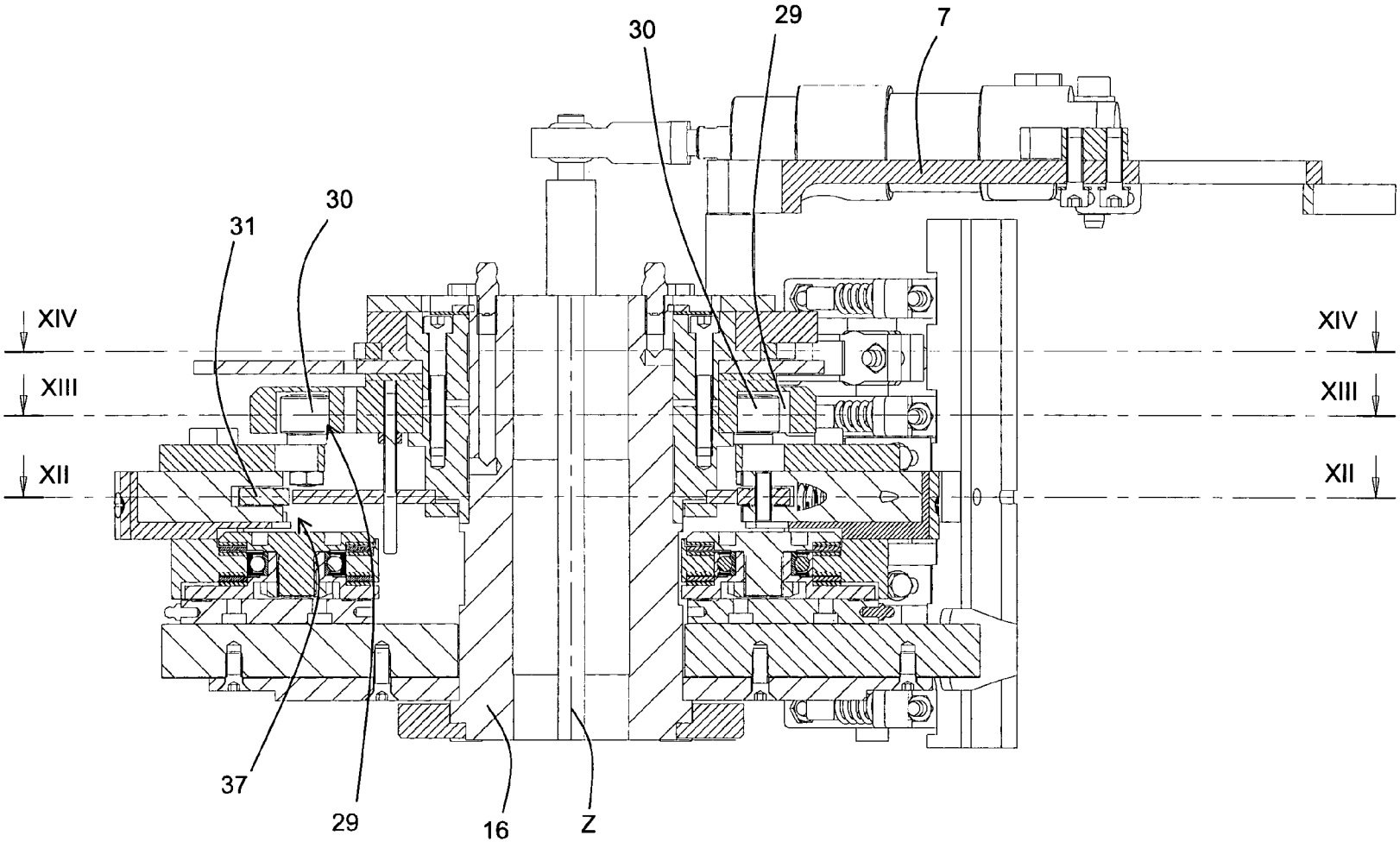
FIG. 10 is a cross-section of the part of the unit of FIG. 9 according to the line X-X.

Finally, in the embodiment illustrated in FIGS. 7 to 21 the supporting structure 7 comprises two parts which can move relative to one another. As shown in FIGS. 7 and 9, the supporting structure 7 comprises a first, stationary part 53 which supports the supporting shaft 16 during the rotation, and a second, mobile part 54 able to rotate relative to the stationary part 53 about the main axis of rotation Z. Interposed between the stationary part 53 and the mobile part 54 there is an actuator 55 which can cause a rotation of approximately 20° by the first, second and third guide elements 29, 42, 50 to displace the phase of machine operation if the container 2 to be labelled is not present (in that case, there would be the risk of getting glue on the pad 14). Consequently, the mobile part 54 can move between an operating position in which the application devices 8, 9 can pick up and apply the labels, and a non-operating position in which label pick up and application are inhibited.

Operation of the unit 1 according to this invention derives immediately from the description of the structure above.

However, for greater clarity, FIGS. 15 to 21 show the upper part of the unit 1 illustrated in the previous Figures, during the application of a label to the neck 5 of a bottle 2. Said Figures show the applying surface radial movement steps, the opening and closing steps of the retaining means 13 and the step during which the pad 14 is pushed against the bottle 2 (FIG. 18 where the pad 14 coming out is illustrated by its interference with the neck 5 of the bottle 2).

This invention brings important advantages.

Thanks to the unit according to this invention it is possible to simultaneously apply two labels to portions of the same container which are at different distances from the axis, on one hand avoiding slipping movements between the label and the container, and on the other hand without limiting machine productivity.

Moreover, the solution proposed which uses only one guide element with two follower elements allows the dimensions and costs of the unit to be minimised.

It should also be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and in practice all of the materials used, as well as the shapes and dimensions of the various components, may vary according to requirements.

The invention claimed is:

1. A unit for the glue application of labels to containers, comprising:

a supporting structure (7);

at least one first application device (8) rotatably mounted on the supporting structure (7) so that it rotates about a main axis of rotation (Z) and therefore cyclically passes between a first label pickup position (25) and a first position (26) for application of the label to a container (2); the first application device (8) comprising at least a first applying surface (10) for pressing a label on a container (2); and the first application device (8) moving along a first trajectory which, at least at the first application position (26), is circular and centred on the main axis of rotation (Z);

first rotation means for moving the first application device (8) along the first trajectory with a first rotational speed relative to the main axis of rotation (Z);

at least one second application device (9) rotatably mounted on the supporting structure (7) so that it rotates about the main axis of rotation (Z), moving along a second trajectory (11) and therefore cyclically passing between a second label pickup position (23) and a second label application position (24); the second application device (9) comprising at least a second applying surface (12) for pressing a label on a container (2);

second rotation means (15) for moving the second application device (9) along the second trajectory (11) with a second rotational speed relative to the main axis of rotation (Z);

the first application device (8) and the second application device (9) being positioned at two separate and superposed portions of the main axis of rotation (Z), each for applying at least one label on a separate portion of the same container (2);

in practice, at least at the second application position (24) the second applying surface (12) being at a distance from the main axis of rotation (Z) which is respectively less than or greater than the distance between the main axis of rotation (Z) and the first applying surface (10) located in its first application position (26); and the second application device (9) also pivoting about an axis of oscillation (O) rotating about the main axis of rotation (Z) with the second rotational speed;

the unit being characterised in that the second rotational speed is identical to the first rotational speed;

also being characterised in that it also comprises a first guide element (29) and in that the second application device (9) comprises two first follower elements (30) which are both slidably connected to the same first guide element (29) for following its course during rotation of the second application device (9) about the main axis of rotation (Z), the interaction between the two first follower elements (30) and the single first guide element (29) producing the second trajectory (11) for movement of the second application device (9);

and also being characterised in that, at least at a stretch of the second trajectory (11) for movement which causes the transit of the second application device (9) close to and at the second application position (24), the interaction between the two first follower elements (30) and the same first guide element (29) causes also a rotation of the second application device (9) about the axis of oscillation (O) in such a way that the second applying surface (12) rotates respectively in the same direction or in the opposite direction to the direction of rotation of the device about the main axis of rotation (Z), respectively if, in practice, at the second application position (24) the second applying surface (12) is at a distance from the main axis of rotation (Z) which is less than or greater than the distance between the main axis of rotation (Z) and the first applying surface (10) located in its first application position (26).

2. The unit according to claim 1, characterised in that the stretch of the second trajectory (11) for movement of the second application device (9) is formed by a portion of the first guide element (29) having the shape of a circular arc centred on an axis of instantaneous rotation which is parallel with the main axis of rotation (Z) and having a radius:

less than the distance between the axis of oscillation (O) and the main axis of rotation (Z) if, in practice, at the second application position (24) the second applying surface (12) is at a distance from the main axis of rotation (Z) which is less than the distance between the main axis of rotation (Z) and the first applying surface (10) located in its first application position (26); or greater than the distance between the axis of oscillation (O) and the main axis of rotation (Z) if, in practice, at the second application position (24) the second applying surface (12) is at a distance from the main axis of rotation (Z) which is greater than the distance between the main axis of rotation (Z) and the first applying surface (10) located in its first application position (26).

3. The unit according to claim 2, characterised in that it comprises a supporting shaft (16) rotatably mounted on the supporting structure (7) and rotating about the main axis of rotation (Z), and also being characterised in that the first application device (8) and the second application device (9) are integral in the rotation with the supporting shaft (16) which therefore produces their rotational speed, and also being characterised in that at least the second application device (9) is slidably mounted on the supporting shaft (16), in such a way that it can move radially relative to the main axis of rotation (Z).

4. The unit according to claim 3, characterised in that at least the second application device (9) comprises means (38) for pushing the second applying surface (12) outwards at least at the second applying surface (12) outwards at least at the second application position (24).

5. The unit according to claim 3, characterised in that the supporting structure (7) comprises a stationary part (53) and a mobile part (54) and at least one actuator (55), which is operatively interposed between them for moving the mobile part (54) between an operating position in which the application devices can pick up and apply the labels, and a non-operating position in which label pick up and application are inhibited.

6. The unit according to claim 3, characterised in that at least one out of the first application device and the second device (9) comprises a pad (14) made of elastically deformable material which respectively forms the first applying surface or the second applying surface (12), the pad (14) in practice being pressed against the container (2) to be labelled; the operating position of the first applying surface (10) and of the second applying surface (12) being the position which the surfaces adopt once the pad (14) has been pressed against the container.

7. The unit according to claim 2, characterised in that at least the second application device (9) comprises means (38) for pushing the second applying surface (12) outwards at least at the second application position (24).

8. The unit according to claim 7, characterised in that the pushing means (38) comprise at least a second guide element (42) integral with the supporting structure (7) and at least a second follower element (41) operatively coupled with the guide element and rigidly connected at least to the second applying surface (12), the interaction between the second follower element (41) and the second guide element (42) causing the second applying surface (12) to be moved outwards at least at the second application position (24).

9. The unit according to claim 2, characterised in that the supporting structure (7) comprises a stationary part (53) and a mobile part (54) and at least one actuator (55) which is operatively interposed between them for moving the mobile part (54) between an operating position in which the application devices can pick up and apply the labels, and a non-operating position in which label pick up and application are inhibited.

10. The unit according to claim 2, characterised in that at least one out of the first application device and the second application device (9) comprises a pad (14) made of elastically deformable material which respectively forms the first applying surface or the second applying surface (12), the pad (14) in practice being pressed against the container (2) to be labelled; the operating position of the first applying surface (10) and the second applying surface (12) being the position which the surfaces adopt once the pad (14) has been pressed against the container.

11. The unit according to claim 1, characterised in that the first guide element (29) is a race and also characterised in that the first follower elements (30) are inserted in the race and spaced out from each other along the race.

12. The unit according to claim 1, characterised in that it comprises a supporting shaft (16) rotatably mounted on the supporting structure (7) and rotating about the main axis of rotation (Z), and also being characterised in that the first application device (8) and the second application device (9) are integral in the rotation with the supporting shaft (16) which therefore produces their rotational speed, and also being characterised in that at least the second application device (9) is slidably mounted on the supporting shaft (16) in such a way that it can move radially relative to the main axis of rotation (Z).

13. The unit according to claim 1, characterised in that at least the second application device (9) comprises means (38) for pushing the second applying surface (12) outwards at least at the second application position (24).

14. The unit according to claim 13, characterised in that the pushing means (38) comprise at least a second guide element (42) integral with the supporting structure (7) and at least a second follower element (41) operatively coupled with the guide element and rigidly connected at least to the second applying surface (12), the interaction between the second follower element (41) and the second guide element (42) causing the second applying surface (12) to be moved outwards at least at the second application position (24).

15. The unit according to claim 1, characterised in that the first application device (8) and the second application device (9) also comprise respective retaining means (13) for retaining the label on the respective applying surface at least during the device passage from the pickup position to the application position.

16. The unit according to claim 1, characterised in that at least at the second pickup position (23) the second trajectory (11) for movement of the second application device (9) is formed by a portion of the first guide element (29) having the shape of a circular arc centred on the main axis of rotation (Z).

17. The unit according to claim 16, characterised in that at least at the pickup positions the first applying surface (10) and the second applying surface (12) are at the same distance from the main axis of rotation (Z).

18. The unit according to claim 1, characterised in that the supporting structure (7) comprises a stationary part (53) and a mobile part (54) and at least one actuator (55) which is operatively interposed between them for moving the mobile part (54) between an operating position in which the application devices can pick up and apply the labels, and a non-operating position in which label pick up and application are inhibited.

19. The unit according to claim 1, characterised in that at least one out of the first application device and the second application device (9) comprises a pad (14) made of elastically deformable material which respectively forms the first applying surface or the second applying surface (12), the pad (14) in practice being pressed against the container (2) to be labelled; the operating position of the first applying surface (10) and of the second applying surface (12) being the position which the surfaces adopt once the pad (14) has been pressed against the container.

* * * * *